US010092079B2

(12) United States Patent
Byun

(10) Patent No.: US 10,092,079 B2
(45) Date of Patent: Oct. 9, 2018

(54) LIQUID COSMETICS CASE

(71) Applicant: Young-Kwang Byun, Seoul (KR)

(72) Inventor: Young-Kwang Byun, Seoul (KR)

( * ) Notice: Subject to any disclaimer, the term of this patent is extended or adjusted under 35 U.S.C. 154(b) by 111 days.

(21) Appl. No.: 15/155,727

(22) Filed: May 16, 2016

(65) Prior Publication Data

US 2016/0360855 A1 Dec. 15, 2016

(30) Foreign Application Priority Data

Jun. 9, 2015 (KR) ..... 10-2015-0080954

(51) Int. Cl.
*A45D 34/04* (2006.01)
*A45D 40/26* (2006.01)

(52) U.S. Cl.
CPC ..... *A45D 34/042* (2013.01); *A45D 34/04* (2013.01); *A45D 40/26* (2013.01); *A45D 2200/054* (2013.01)

(58) Field of Classification Search
CPC ... B05B 11/3091; A45D 40/26; A45D 34/042; A45D 34/04; A45D 2200/054
USPC ..... 222/547, 340, 326, 386; 401/178, 270, 401/269, 278, 273
See application file for complete search history.

(56) References Cited

U.S. PATENT DOCUMENTS 3,400,997 A * 9/1968 Schwartzman ..... B65D 47/42 401/186
3,901,414 A * 8/1975 Capra ..... B05B 9/0883 222/340
4,993,437 A * 2/1991 Kimura ..... A45D 19/02 132/112
5,310,092 A * 5/1994 Targell ..... B05B 11/3092 222/167
6,363,948 B2 * 4/2002 Choi ..... A45D 33/02 132/313
6,945,472 B2 * 9/2005 Wuttke ..... A61M 11/06 239/321
7,377,711 B2 * 5/2008 Byun ..... A45D 34/042 401/269
8,177,452 B2 * 5/2012 Tsai ..... A45D 34/042 401/204
9,161,605 B2 * 10/2015 Kim ..... B05B 11/0048
(Continued)

FOREIGN PATENT DOCUMENTS

KR 10-0702621 3/2007

*Primary Examiner* — Charles P Cheyney
(74) *Attorney, Agent, or Firm* — Kaplan Breyer Schwarz, LLP

(57) ABSTRACT

A liquid cosmetics case includes a body filled with a liquid content and having one end in which a valve insertion part communicating with a discharge hole is defined, a valve unit installed to be inserted into the insertion part, the valve unit opening and closing the discharge hole, a solder unit coupled to one end of the body to support the valve unit and in which a hollow discharge tube is provided, and a valve actuator unit rotatably coupled to the solder unit, the valve actuator being rotated to elevate a nozzle of the valve unit, thereby opening and closing the discharge hole, wherein, when the valve actuator is rotated to allow the valve nozzle to descend, the discharge hole is opened to discharge the content, and when the valve actuator is rotated to allow the valve nozzle to ascend, the discharge hole is closed to block the discharge of the content.

10 Claims, 33 Drawing Sheets

(56) References Cited

U.S. PATENT DOCUMENTS

| | | | | |
|---|---|---|---|---|
| 2014/0076341 | A1* | 3/2014 | Byun | A45C 13/008<br>132/112 |
| 2014/0231464 | A1* | 8/2014 | Cho | B05B 11/0037<br>222/321.8 |
| 2016/0058154 | A1* | 3/2016 | Jung | A45D 34/00<br>222/382 |
| 2016/0088921 | A1* | 3/2016 | Jo | B05B 11/3052<br>222/173 |
| 2016/0242530 | A1* | 8/2016 | Son | A45D 34/04 |

* cited by examiner

LIQUID COSMETICS CASE

CROSS-REFERENCE TO RELATED APPLICATION

This application claims priority to and the benefit of Korean Patent Application No. 10-2015-0080954, filed on Jun. 9, 2015, the disclosure of which is incorporated herein by reference in its entirety.

FIELD OF THE INVENTION

The present invention relates to a cosmetics case, and more particularly, to a liquid cosmetics case that is rotated to open a valve nozzle, thereby discharging a liquid content.

BACKGROUND OF THE INVENTION

In general, liquid cosmetics for facial makeup is contained in a case, and then, when applying makeup, the liquid content within the case is discharged for use.

In the related art, button type and rotary type liquid cosmetics cases have been mainly applied as a manner for discharging a liquid content within a liquid cosmetics case.

The button type liquid cosmetics case has a structure in which an applicator having a button shape is provided on an upper or side portion of a case body, and the button is repeatedly pushed to discharge a liquid content within the case. However, when the button is installed on the upper or side portion of the case body, the case may be complicated in structure, the number of components may increase to raise manufacturing costs, and malfunction may occur.

Also, when the button is applied to a lower portion of the case body as another example of the button type liquid cosmetics case, the total length of the case body may increase to cause deterioration in outer appearance and inconvenience in use.

The rotary type liquid cosmetics case has a structure in which the case is screw-rotated within the body to move, thereby discharging a liquid content within the case. However, the rotary type liquid cosmetics case may be applied to only contents having viscosity, and since a discharging portion is always opened, the content may be discharged regardless of the intension of a user to cause a limitation in sealability.

PRIOR ART DOCUMENTS

Patent Documents (Patent Document 0001) Korean Patent Registration No. 10-0702621

SUMMARY OF THE INVENTION

Accordingly, the present invention is directed to a liquid cosmetics case that substantially obviates one or more problems due to limitations and disadvantages of the related art. An object of the present invention is to provide a liquid cosmetics case that is rotated to open a valve nozzle, thereby discharging a liquid content.

To solve the foregoing objects, a liquid cosmetics case includes: a case body filled with a liquid content and having one end in which a valve insertion part communicating with a discharge hole is defined; a valve unit installed to be inserted into the valve insertion part, the valve unit opening and closing the discharge hole; a solder unit coupled to one end of the case body to support the valve unit and in which a hollow discharge tube is provided; and a valve actuator unit rotatably coupled to the solder unit, the valve actuator unit being rotated to elevate a valve nozzle of the valve unit, thereby opening and closing the discharge hole, wherein, when the valve actuator unit is rotated to allow the valve nozzle to descend, the discharge hole is opened to discharge the content, and when the valve actuator unit is rotated to allow the valve nozzle to ascend, the discharge hole is closed to block the discharge of the content.

Also, the valve unit may include: a valve housing inserted and coupled to the valve insertion part from the outside the case body; the valve nozzle passing through the valve housing to vertically move, the valve nozzle having a nozzle hole communicating with the discharge tube therein and an inflow hole connected to the nozzle hole to introduce the content into the nozzle hole in a side portion thereof; a switching member movably fitted outside the valve nozzle, the switching member being pushed to a side opposite to the discharge hole by a pressure of the content introduced between the valve housing and the valve nozzle to open the inflow hole when the valve nozzle moves toward the discharge hole and pushed by the valve nozzle to return to its original state and close the inflow hole when the valve nozzle moves to the side opposite to the discharge hole; and a valve cap coupled to the valve housing so that an upper portion of the valve nozzle passes through the valve cap.

Also, the valve nozzle may include: a nozzle body in which the nozzle hole opened to one end thereof is defined in a longitudinal direction, and the inflow hole connected to the nozzle hole is defined in a side portion thereof; and an annular protrusion disposed at a position of the side portion of the nozzle body, which is spaced apart from the inflow hole toward the other closed end of the nozzle body, the annular protrusion having a fine hole through which the content introduced between the other end of the nozzle body and the valve housing passes.

Also, the solder unit may include: a solder body fitted and coupled to the outside of one end of the case body; and a hollow discharge tube extending perpendicular to a central portion of a top surface of the solder body and to which the valve nozzle of the valve unit is connected to the inside thereof.

Also, the valve actuator unit may include: a first cam part fitted and coupled to the outside of the valve nozzle from an upper side of the valve cap and in which a discharge hole communicating with the nozzle hole of the valve nozzle is defined to pass through a center thereof, and a plurality of first inclined sawteeth are disposed on an upper end of an outer circumferential surface thereof; an elastic member installed to elastically support the first cam part with respect to the valve cap; a rotating cap fitted and rotatably coupled to the outside of the solder unit; and a second cam part coupled to the inside of the rotating cap and in which a discharge hole connected to the through hole of the first cam part is defined to pass through a center thereof, and a plurality of second inclined sawteeth engaged with the first inclined sawteeth are disposed on a lower end of an outer circumferential surface thereof.

Also, the first cam part may be interlocked with rotation of the second cam part to vertically move in the discharge tube of the solder unit, and the first inclined sawteeth may protrude upward from the discharge tube and are engaged with the second inclined sawteeth.

Also, at least one rotation prevention protrusion may protrude from an outer circumferential surface of the first cam part, and at least one elevation guide groove may be longitudinally defined in an inner circumferential surface of the discharge tube of the solder unit so that the rotation prevention protrusion is inserted into the elevation guide groove, and the first cam part may be elevated without the rotation of the first cam part by being interlocked with the rotation of the second cam part.

Also, the first cam part may include: a first cam body having a hollow circular tube shape, the first cam body having one end fitted and connected to the outside of a connection tube disposed on the second cam part and the other end into which the opened end of the nozzle body is fitted; an elastic member support part extending to the outside of the first cam body to support the elastic member fitted outside the other end of the first cam body; a plurality of first inclined sawteeth disposed on an upper end of an outer circumferential surface of the first cam body; and at least one rotation prevention protrusion disposed on the outer circumferential surface of the first cam body and inserted into the elevation guide groove.

Also, the rotating cap may include: a rotation coupling part having a hollow circular tube shape and fitted and rotatably coupled to the outside of the solder unit; a lid coupling part extending from one end of the rotation coupling part and having inner and outer diameters less than those of the rotation coupling part and in a case lid is detachably fitted to the outside thereof; a brush holder coupling part extending from one end of the lid coupling part and having inner and outer diameters less than those of the lid coupling part and a closed top surface and in which a brush holder is detachably fitted to the outside thereof; and a hollow cam coupling part extending inward from a center of a top surface of the brush holder coupling part and to which the second cam part is coupled.

Also, the rotation coupling part may include a rotation coupling protrusion that protrudes from an inner circumferential surface of the rotation coupling part so that the rotation coupling protrusion is fitted and rotatably coupled to the rotation coupling groove defined in the outer circumferential surface of the solder unit.

Also, the brush holder coupling part may have a transfer tube insertion hole, through which a transfer tube disposed on one end of the second cam part is inserted to pass, in a center of a top surface thereof.

Also, the second cam part may include: a second cam body having a hollow circular tube shape, the second cam body having one end on which a transfer tube is disposed to pass through the transfer tube insertion hole and protrude upward from the rotating cap and the other end on which a connection tube is disposed to be fitted and coupled to one end of the first cam part; a plurality of second inclined sawteeth disposed on a lower end of an outer circumferential surface of the second cam body and engaged with the first inclined sawteeth; and at least one fixed protrusion disposed on the outer circumferential surface of the second cam body and inserted and fixed to a plurality of fixing grooves defined in an inner circumferential surface of the cam coupling part.

DETAILED DESCRIPTION

A liquid cosmetics case according to preferred embodiments of the present invention will be described below in detail with reference to the accompanying drawings. For reference, detailed descriptions related to well-known functions or configurations will be ruled out in order not to unnecessarily obscure subject matters of the present disclosure.

Figure 1:
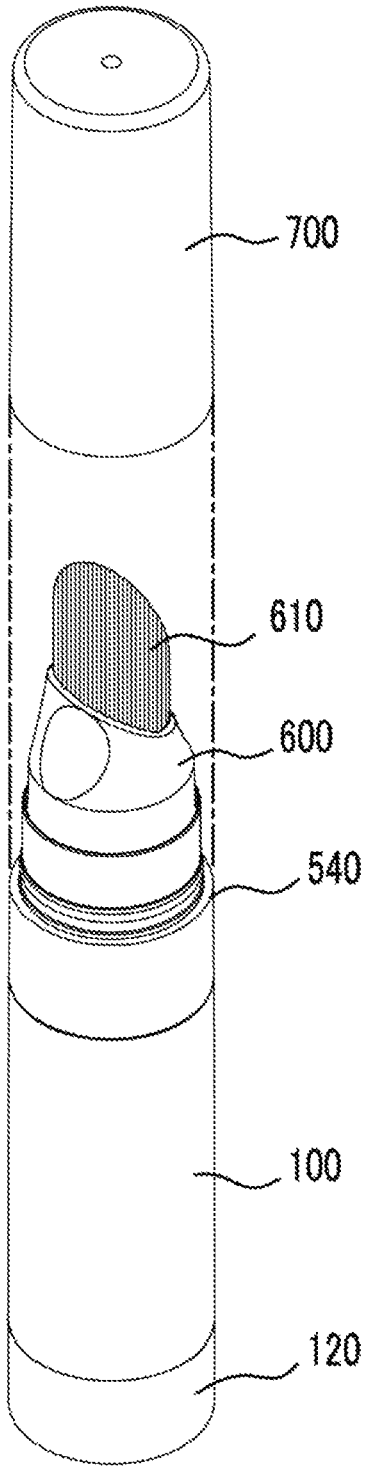
FIG. 1 is a perspective view of a liquid cosmetics case according to an embodiment of the present invention.
Figure 2:
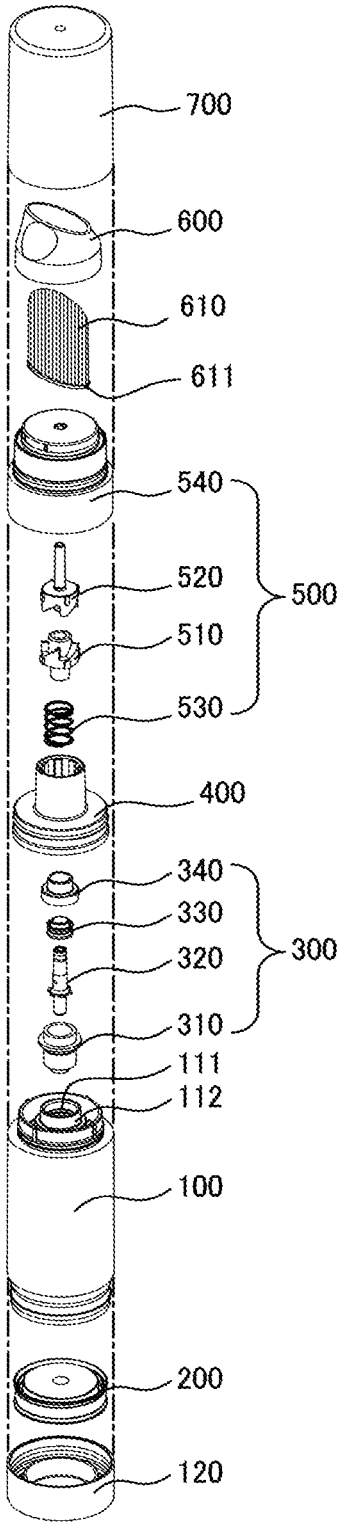
FIG. 2 is an exploded perspective view of FIG. 1.
Figure 3:
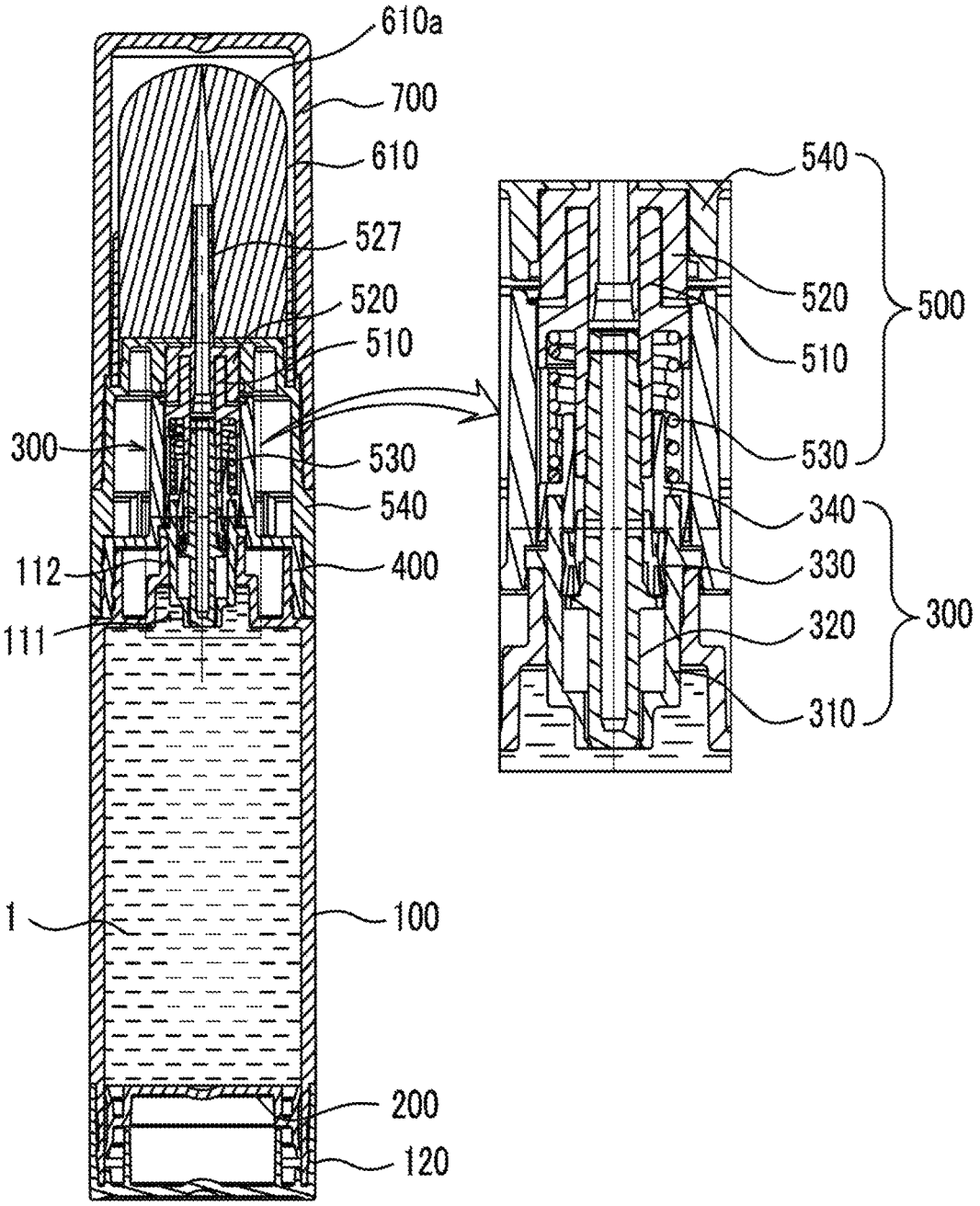
FIG. 3 is a longitudinal cross-sectional view of FIG. 1.

FIG. 1 is a perspective view of a liquid cosmetics case according to an embodiment of the present invention, FIG. 2 is an exploded perspective view of FIG. 1, and FIG. 3 is a longitudinal cross-sectional view of FIG. 1.

As illustrated in FIGS. 1 to 3, the liquid cosmetics case according to an embodiment of the present invention may include a case body 100, a pressing holder unit 200, a valve unit 300, a solder unit 400, a valve actuator unit 500, a brush holder 600, and a case lid 700.

A liquid cosmetics content (see reference numeral 1 of FIG. 27) is filled into the case body 1000. A valve insertion part (see reference numeral 112 of FIG. 4) communicating with a discharge hole (see reference numeral 111 of FIG. 4) for discharging the content 1 is disposed on one end of the case body 100.

The pressing holder unit 200 is slidably inserted into the case body 1000 to push the liquid content 1 toward a discharge side, i.e., the discharge hole 111 of the case body 100 so that the content 1 within the case body 100 is smoothly discharged. The liquid content 1 is filled between the discharge side of the case and the pressing holder unit 200 in the case body 100.

The valve unit 300 is inserted and coupled to the valve insertion part 112 from the outside of the case body 100 to open and close the discharge hole 111 so that the liquid content 1 within the case body 100 is discharged to the outside, or the discharge of the content 1 to the outside is blocked. The valve unit 300 may include a valve housing 310, a valve nozzle 320, a switching member 330, and a valve cap 340.

The solder unit 400 is coupled to one end of the case body 100 to support the valve unit 300.

The valve actuator unit 500 is rotatably coupled to the solder unit 400. When the valve actuator unit 500 is rotated, the valve nozzle 320 of the valve unit 300 is elevated to open and close the discharge hole 111. That is, the valve actuator unit 500 may convert rotation movement into vertical linear movement of the valve nozzle 320 to open and close the discharge hole 111, thereby discharging and blocking the content. For example, when the valve actuator unit 500 is rotated to allow the valve nozzle 320 to descend, the discharge hole 111 may be opened to discharge the content 1. On the other hand, when the valve actuator unit 500 is rotated to allow the valve nozzle 320 to ascend, the discharge hole 111 may be closed to block the discharge of the content 1. The valve actuator unit 500 may include a first cam part 510, a second cap part 520, an elastic member 530, and a rotating cap 540.

The brush holder 600 supports and couple a makeup brush 610 to the discharge side of the valve actuator unit 500.

The case lid 700 is detachably coupled to the valve actuator unit 500. Thus, when the case lid 700 is used, the case lid 700 may be separated from the valve actuator unit 500 to expose the brush 610 to the outside. When the case lid 700 is not used, the case lid 700 may be coupled to the valve actuator unit 500 to cover the brush 610 so that the brush 610 is not exposed to the outside.

Figure 4:
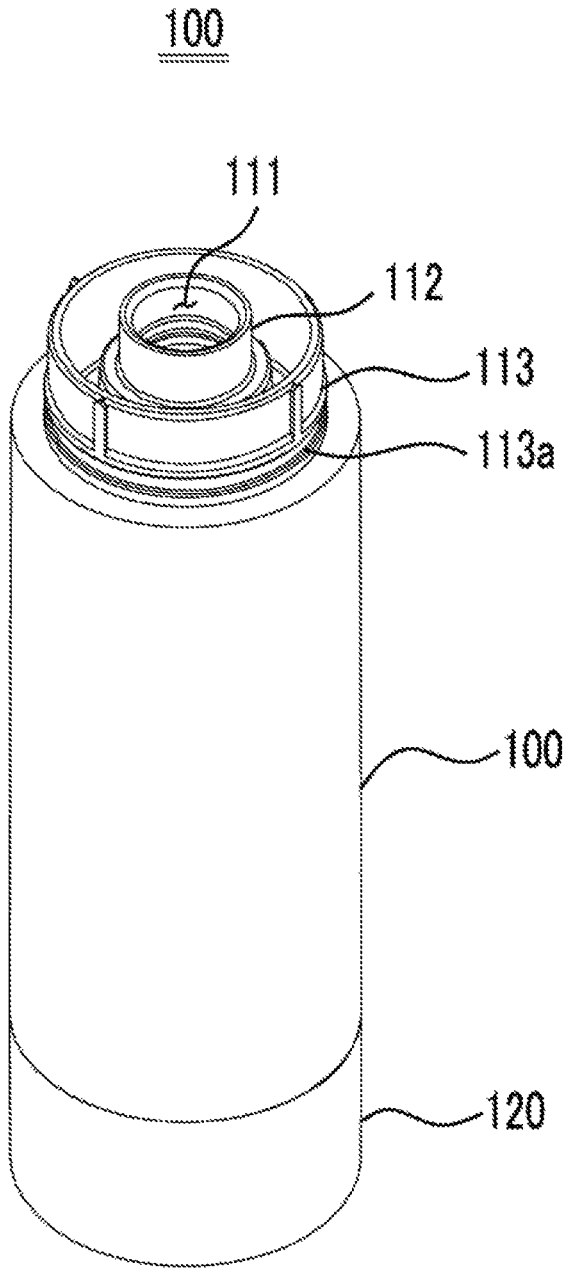
FIG. 4 is a perspective view of a case body of FIG. 2.
Figure 5:
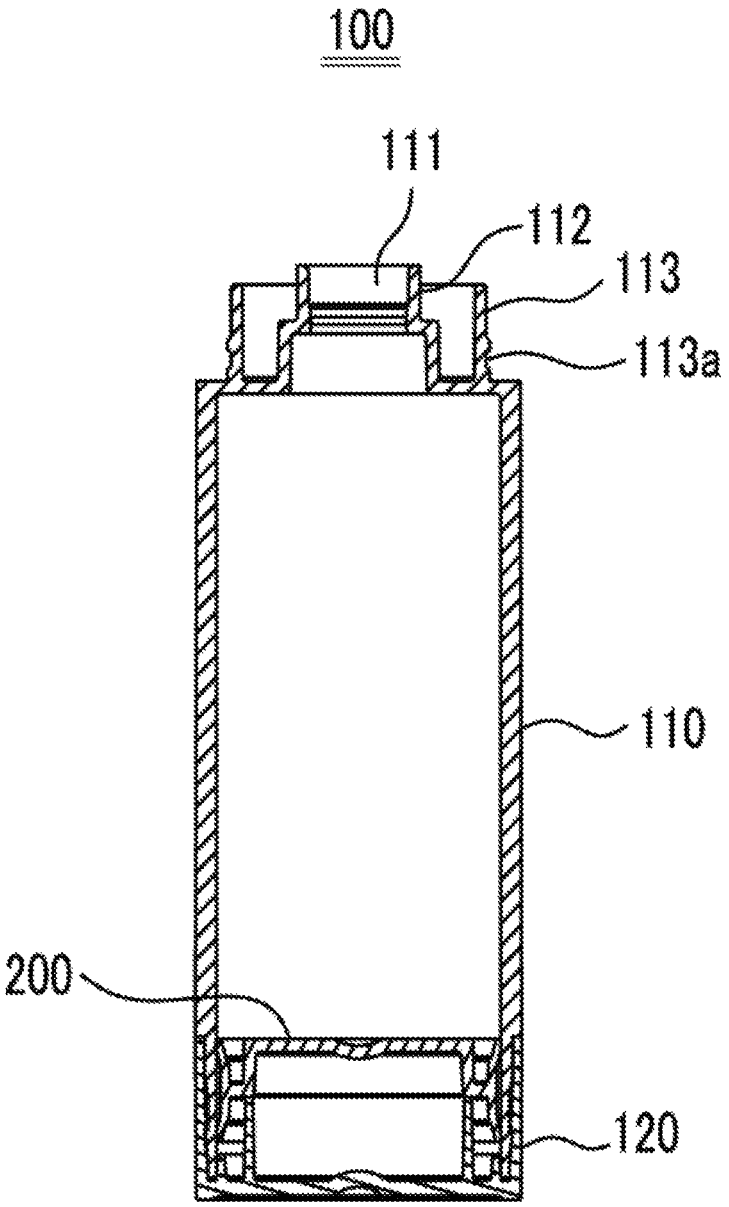
FIG. 5 is a longitudinal cross-sectional view of FIG. 4.

FIG. 4 is a perspective view of a case body of FIG. 2, and FIG. 5 is a longitudinal cross-sectional view of FIG. 4.

As illustrated in FIGS. 4 and 5, the case body 100 includes a case body part 110 having a hollow circular tube shape to form a space in which the liquid content 1 is filled into the case body part 110. The valve insertion part 112 communicating with the discharge hole 111 for discharging the content 1 is disposed on one end of the case body 100, and a case stopper 120 is coupled to the other opened end of the case body 100 to close an opened surface of the case body 100. Also, a solder coupling part 113 extending from one end of the case body 100 and having inner and outer diameters less than those of the case body 100 so that an outer circumferential surface of the solder coupling part 113 is inserted and coupled onto an inner circumferential surface of the solder unit 400 is fitted may be provided. A hook groove 113*a* may be defined in the outer circumferential surface of the solder coupling part 113 so that a hook protrusion 411*a* disposed on the inner circumferential surface of the solder body 410 is inserted and coupled to the hook groove 113*a*.

Figure 6:
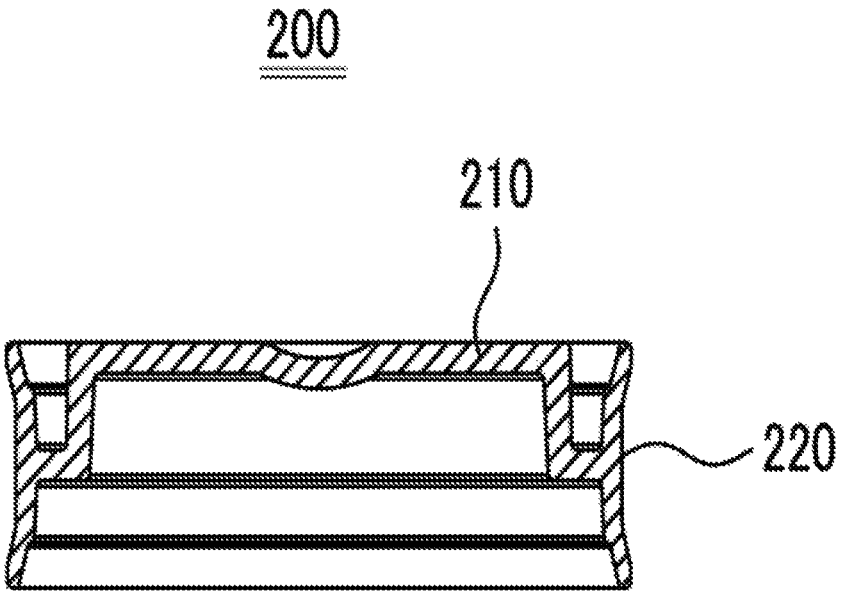
FIG. 6 is a cross-sectional view of a pressing holder unit of FIG. 2.

FIG. 6 is a cross-sectional view of the pressing holder unit of FIG. 2.

As illustrated in FIG. 6, the pressing holder unit 200 may include a pressing part 210 inserted into the case body 100 to push the content within the case body 100 toward the discharge side of the case body 100 and a contact part 220 disposed on an edge of the pressing part 210 to slidably contact the inner circumferential surface of the case body 100. The contact part 220 may have a shape of which a central portion is relatively recessed toward a center of the pressing part 210 when compared to both ends the contact part 220. Thus, the central portion of the contact part 220 may not contact the inner circumferential surface of the case body 100, and only both ends of the contact part 220 may slidably contact the inner circumferential surface of the case body 100.

Figure 7:
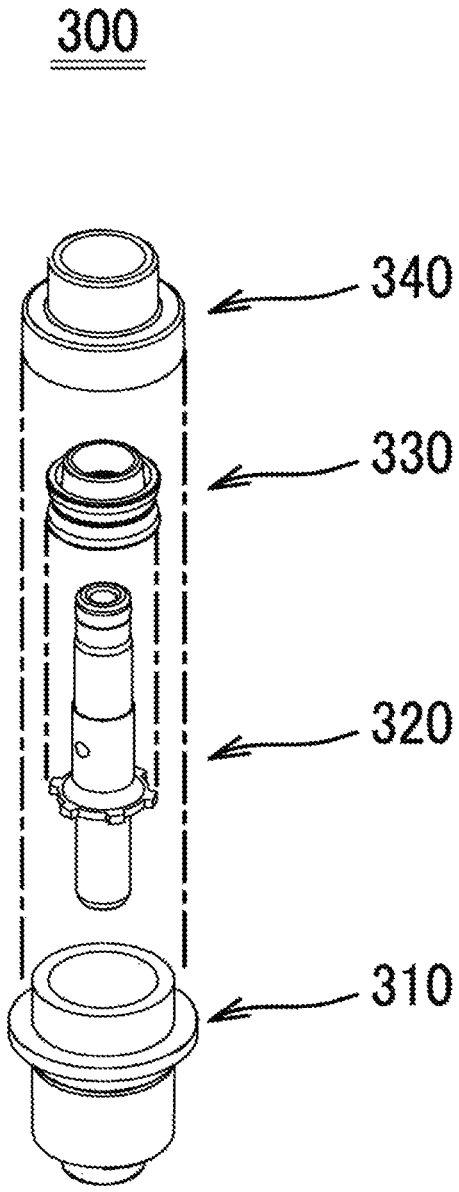
FIG. 7 is an exploded perspective view of a valve unit of FIG. 2.

FIG. 7 is an exploded perspective view of the valve unit of FIG. 2.

As illustrated in FIG. 7, the valve unit 300 may include a valve housing 310 inserted and coupled to the valve insertion part 112 of the case body 100, a vertically movable valve nozzle 320 passing through the valve housing 310, a switching member 330 fitted outside the valve nozzle 320, and a valve cap 340 coupled to an upper end of the valve housing 310.

Detailed constituents of the valve unit 300 will be described in detail with reference to FIGS. 8 to 13.

Figure 8:
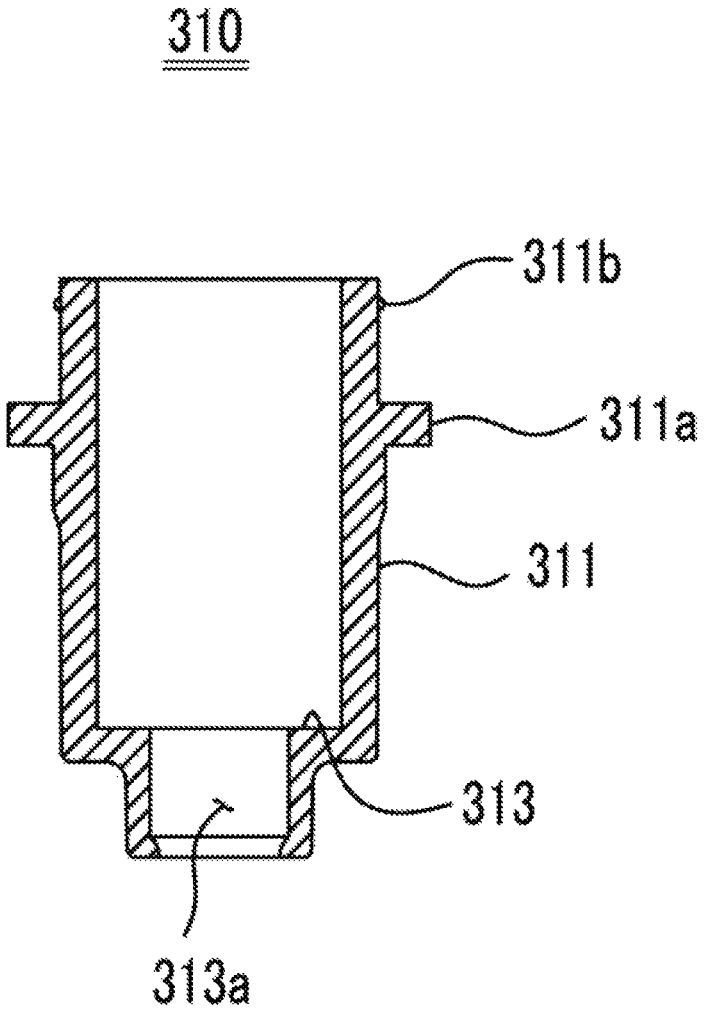
FIG. 8 is a cross-sectional view of a valve housing of FIG. 7.

FIG. 8 is a cross-sectional view of the valve housing of FIG. 7.

As illustrated in FIG. 8, the valve housing 310 is inserted and coupled to the valve insertion part 112 from the outside of the case body 100. The valve housing 310 may include a nozzle insertion part 310 and a stepped part 313.

The nozzle insertion part 311 has a hollow circular tube shape. The nozzle insertion part 311 may have an outer diameter approximately corresponding to an inner diameter of the valve insertion part 112 so that an outer circumferential surface of the nozzle insertion part 311 is closely attached to contact an inner circumferential surface of the valve insertion part 112 when the nozzle insertion part 311 is inserted into the valve insertion part 112 of the case body 100. Also, an insertion prevention protrusion 311*a* having an annular shape may be disposed on the outer circumferential surface 311 of the nozzle insertion part 311 to prevent the nozzle insertion part 311 from being further inserted into the case body 100 through the valve insertion part 112.

The stepped part 313 extends in a stepped shape inward from the other end of the nozzle insertion part 31, and a through hole 313*a* is defined in a central portion of the stepped part 313 so that the valve nozzle 320 of the valve unit 300 is slidably fitted. An annular protrusion 323, which will be described below, of the valve nozzle 320 may be hooked with the stepped part 313 to prevent the nozzle body 321 from being further slid downward, thereby preventing the valve nozzle 320 from being separated from the nozzle insertion part 311.

When the valve nozzle 320 is slid downward within the nozzle insertion part 311, a gap may be generated between the stepped part 313 and the valve nozzle 320. Here, the content 1 filled into the case body 100 may be introduced into the nozzle insertion part 311 through the gap. On the other hand, when the valve nozzle 320 is slid upward, the gap between the stepped part 313 and the valve nozzle 320 may be closed to block the introduction of the content 1, which is filled into the case body 100, into the nozzle insertion part 311.

Figure 9:
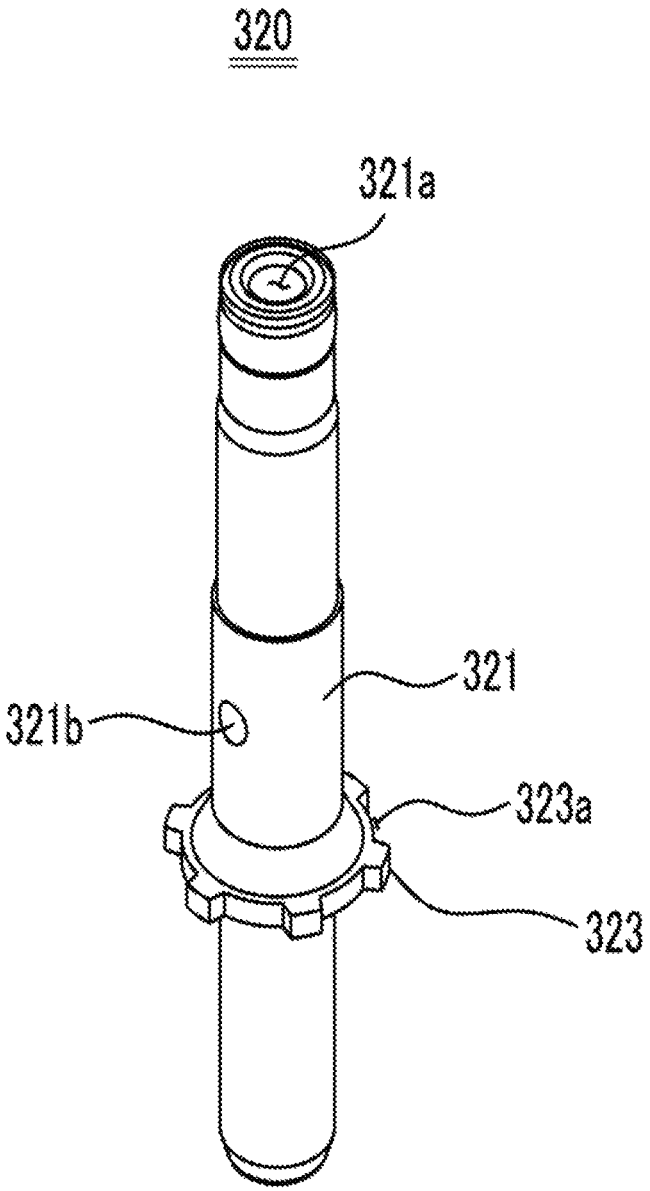
FIG. 9 is a perspective view of a valve nozzle of FIG. 7.
Figure 10:
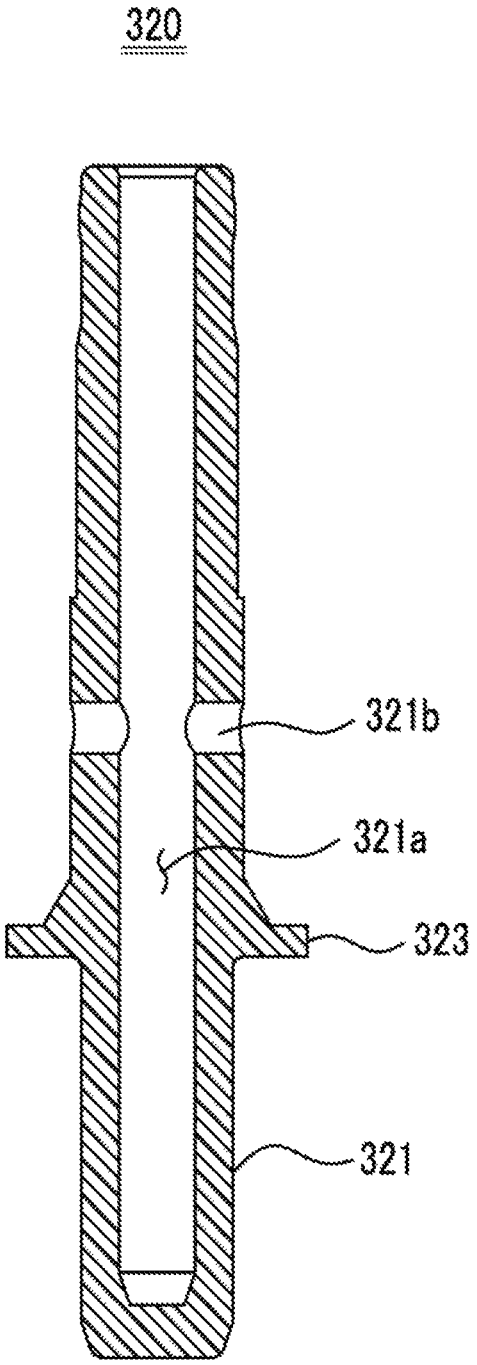
FIG. 10 is a longitudinal cross-sectional view of FIG. 9.

FIG. 9 is a perspective view of the valve nozzle of FIG. 7, and FIG. 10 is a longitudinal cross-sectional view of FIG. 9.

As illustrated in FIGS. 9 and 10, the valve nozzle 320 is installed to slidably pass through the nozzle insertion part 311 of the valve housing 310. The valve nozzle 320 may include the nozzle body 321 and the annular protrusion 323.

A nozzle hole 321*a* that is opened to one end of the nozzle body 321 is lengthily defined in the nozzle body 321, and an inflow hole 321*b* connected to the nozzle hole 321*a* is defined in a side portion of the nozzle body 321.

The annular protrusion 323 is disposed at a position of the side portion of the nozzle body 321, which is spaced apart from the inflow hole 321*b* toward the other closed end of the nozzle body 321 and is hooked with the stepped part 313 disposed on the nozzle insertion part 311 of the valve housing 310 to prevent the nozzle body 321 from being further slid downward. Also, a plurality of fine holes 323*a* through which the liquid content 1 introduced between the other end of the nozzle body 321 and the valve housing 310 passes are defined to be spaced apart from each other in the annular protrusion 323.

Figure 11:
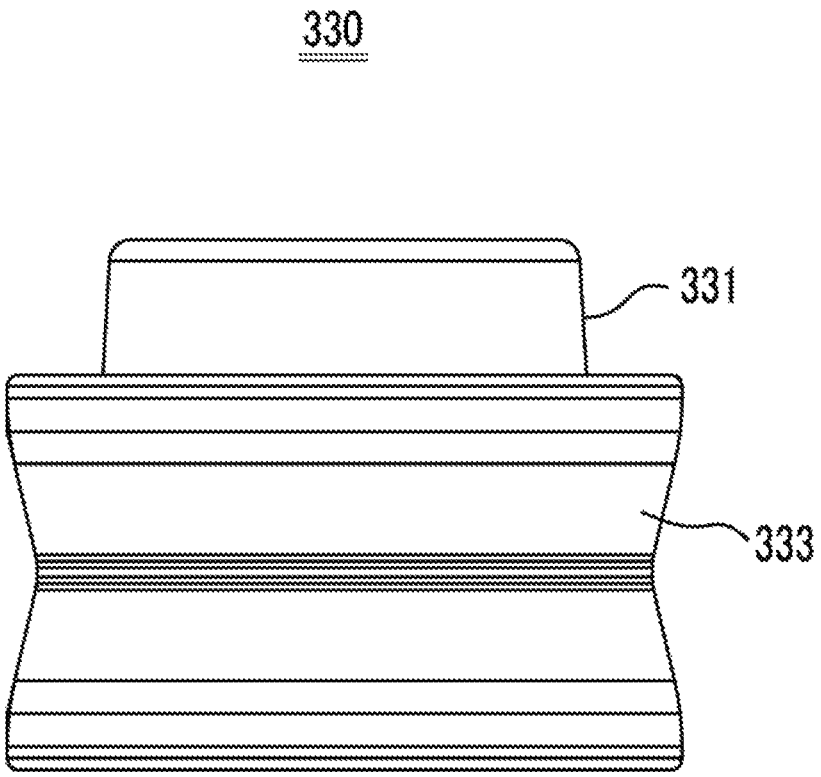
FIG. 11 is a side view of a switching member of FIG. 7.
Figure 12:
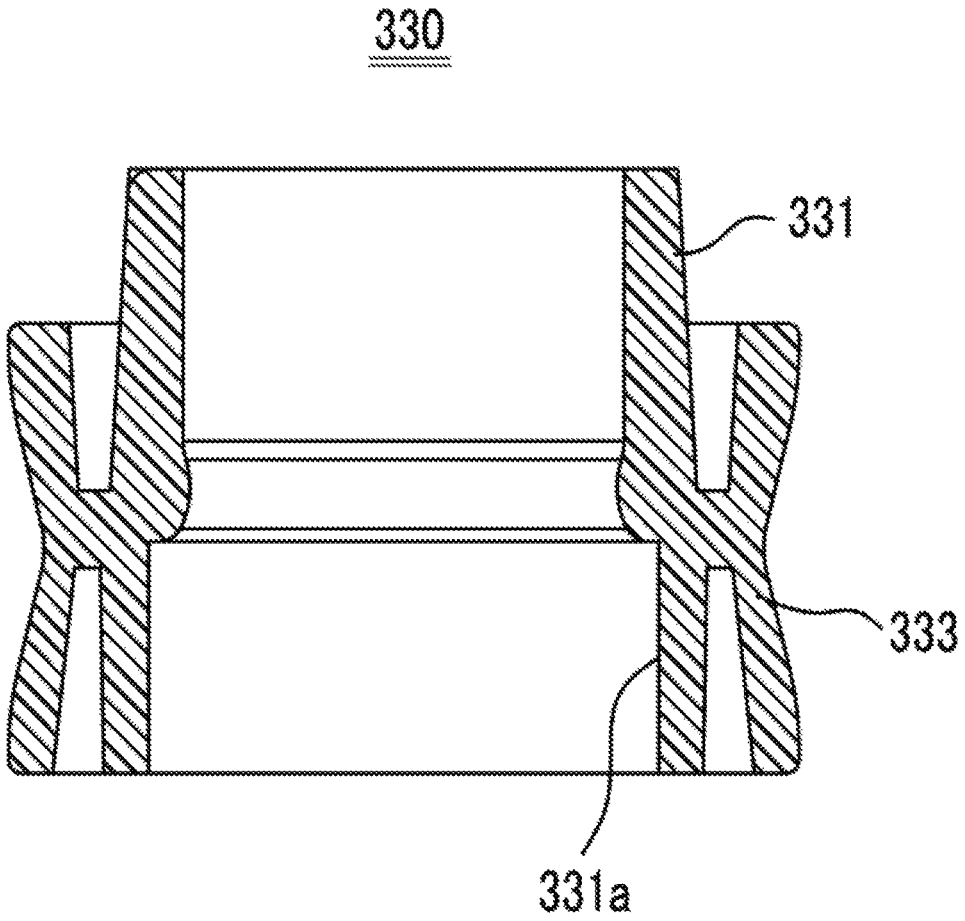
FIG. 12 is a longitudinal cross-sectional view of FIG. 11.

FIG. 11 is a side view of the switching member of FIG. 7, and FIG. 12 is a longitudinal cross-sectional view of FIG. 11.

As illustrated in FIGS. 11 and 12, the switching member 330 is movably fitted outside the nozzle body 321. Thus, when the nozzle body 321 moves to the discharge hole 111, i.e., when the nozzle body 321 descends in the drawings, the switching member 330 is pushed to a side opposite to the discharge hole 111 by a pressure of the content 1 introduced between the valve housing 310 and the nozzle body 321 to open the inflow hole 321*b*. When the nozzle body 321 moves to the side opposite to the discharge hole 111, i.e., when the nozzle body 321 ascends in the drawing, the switching member 330 is pushed by the nozzle body 321 to return to its original state, thereby closing the inflow hole 321*b*. Here, the switching member 330 may be movably fitted into a portion of the nozzle body 321, in which the inflow hole 321*b* is defined with respect to the annular protrusion 323.

The switching member 330 may include a hollow switching part 331 that is fitted outside the nozzle body 321 and a contact part 333 extending to the outside of the switching part 331 to slidably contact the inside of the nozzle insertion part 311 of the valve housing 310.

A clearance groove 331*a* defining a clearance without contacting the nozzle body 321 is defined in a portion of an inner circumferential surface of the switching part 331 at a side of the annular protrusion 323 of the valve nozzle 320. Thus, when the switching part 331 is slid to a side opposite to the annular protrusion 323 to allow the clearance groove 331*a* to overlap the inflow hole 321*b*, the content introduced into the clearance groove 331*a* is introduced into the nozzle hole 321*a* through the inflow hole 321*b*. On the other hand, when the switching part 331 is slid toward the annular protrusion 323 to allow the clearance groove 331*a* to be dislocated with respect to the inflow hole 321*b*, the introduction of the content 1 through the inflow hole 321*b* is blocked by the inner circumferential surface of the switching part 331 contacting the nozzle body 321.

The contact part 333 has a shape of which a central portion is relatively recessed in an inner direction of the switching part 331 when compared to both ends of the contact part 333. Thus, the central portion of the contact part 333 does not contact an inner circumferential surface of the nozzle insertion part 311, and only both ends of the contact part 333 slidably contacts the inner circumferential surface of the nozzle insertion part 311.

Figure 13:
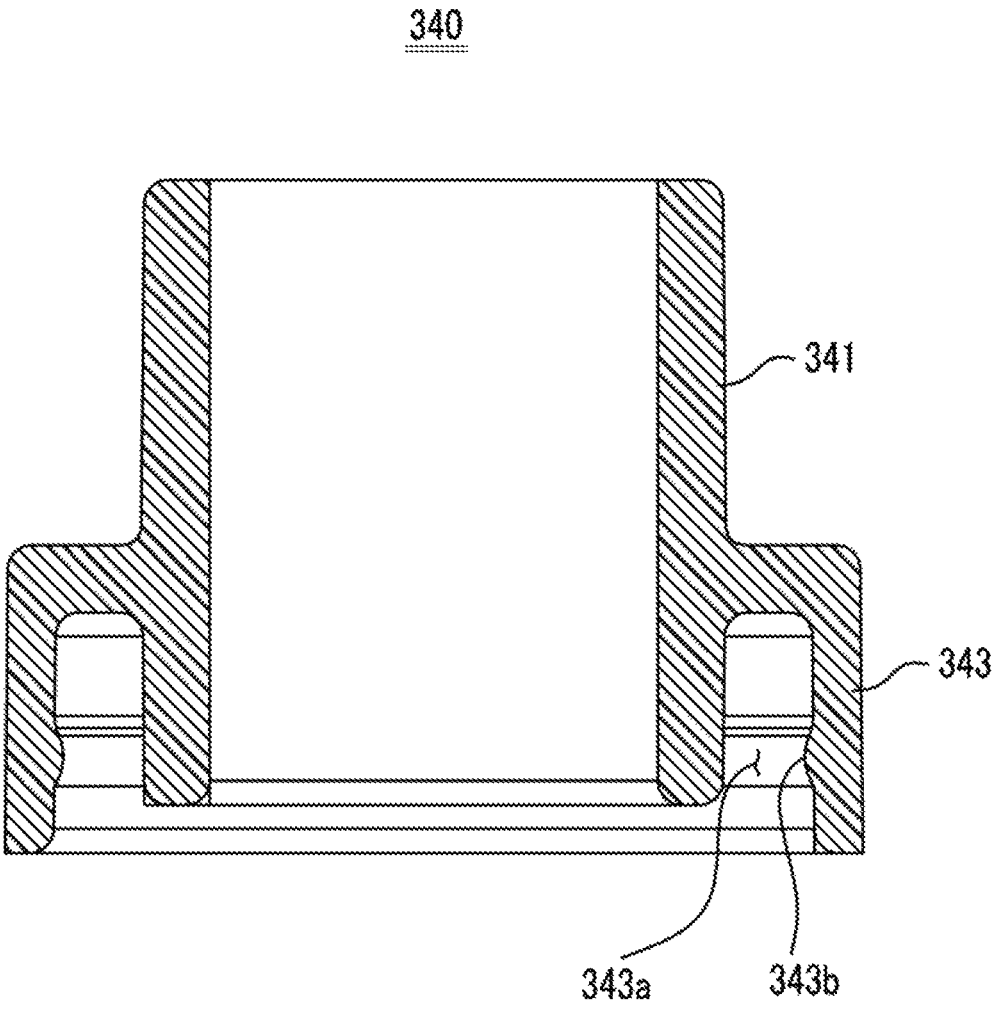
FIG. 13 is a cross-sectional view of a valve cap of FIG. 7.

FIG. 13 is a cross-sectional view of the valve cap of FIG. 7.

As illustrated in FIG. 13, the valve cap 340 is coupled to an upper end of the valve housing 310 to electrically support the first cam part 510 that will be described below by the elastic member 530, e.g., a spring (hereinafter, expressed by reference numeral 530). The valve cap 340 may include a valve cap body 341 having a hollow circular tube shape and fitted outside a lower end of the first cam part 510 and a cap coupling part 343 extending to be bent from the outside of the valve cap body 341 in a direction of one end thereof and having a fit-coupling groove 343*a* into which an upper end of the nozzle insertion part 311 of the valve housing 310 is fitted and coupled between one end of the valve cap body 341 and the cap coupling part 343. A hook protrusion 343*b* that is hooked with a hook protrusion 311*b* disposed on an outer surface of the nozzle insertion part 311 to allow the valve cap 340 to be engaged and coupled the valve housing 310 may protrude from an inner surface of the cap coupling part 343.

Figure 14:
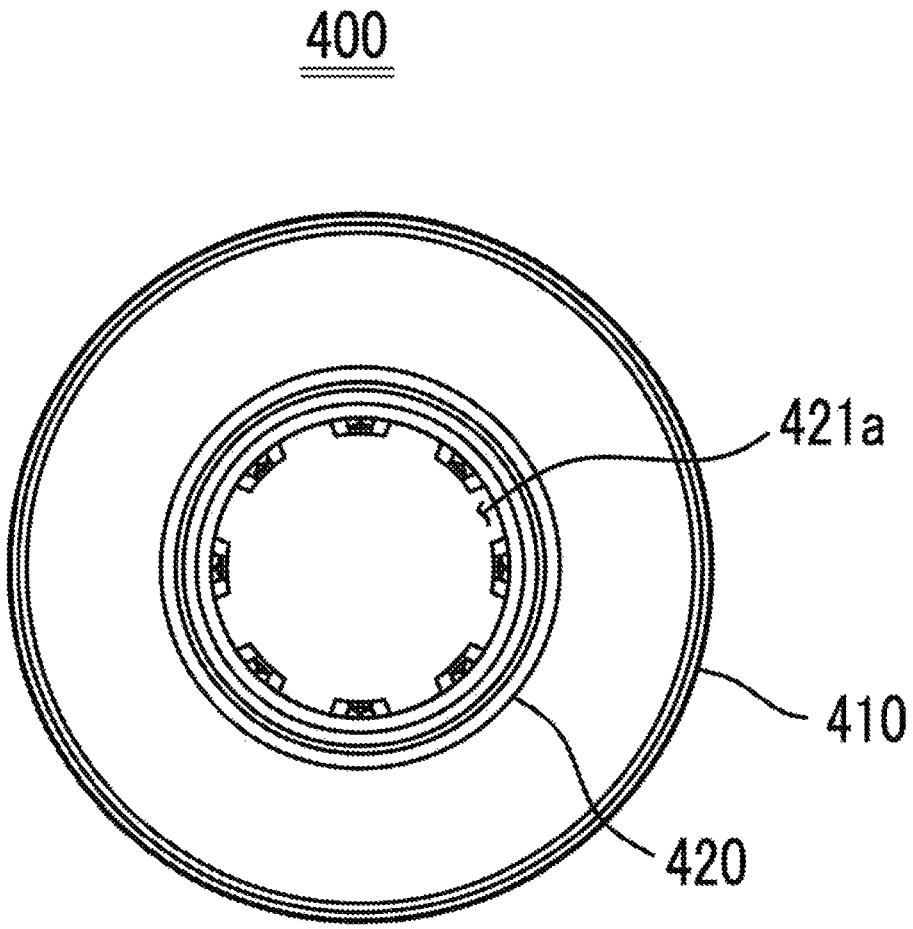
FIG. 14 is a plan view of a solder unit of FIG. 2.
Figure 15:
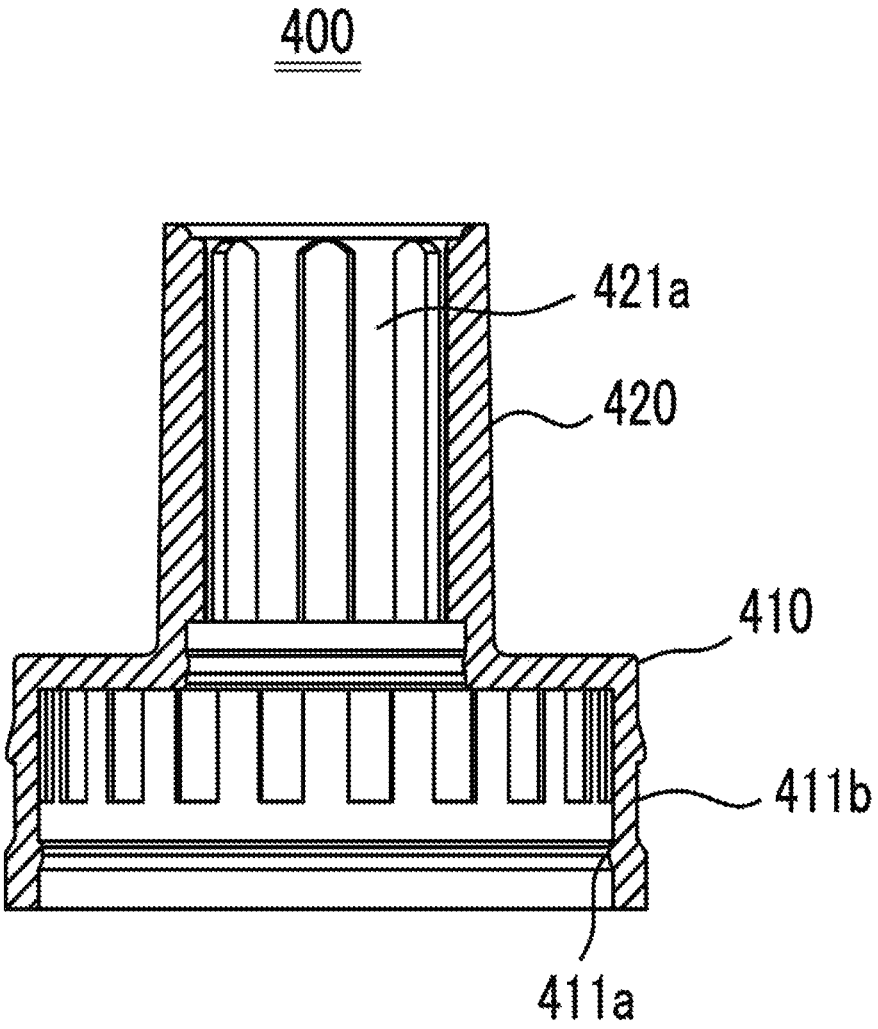
FIG. 15 is a cross-sectional view of the solder unit of FIG. 2.

FIG. 14 is a plan view of the solder unit of FIG. 2, and FIG. 15 is a cross-sectional view of the solder unit of FIG. 2.

As illustrated in FIGS. 14 and 15, the solder unit 400 is fitted and coupled to the outside of one end of the case body 100 in which the valve unit 300 is installed. The solder unit 400 may include a solder body 410 and a discharge tube 420.

The solder body 410 has a hollow circular tube shape. An inner circumferential surface of an opened lower end of the solder body 410 is fitted and coupled to an outer circumferential surface of the solder coupling part 113 disposed on one end of the case body 100. Here, a hook protrusion 411*a* coupled to be engaged and fitted into the hook groove 113*a* defined in the outer circumferential surface of the solder coupling part 113 protrudes from the inner circumferential surface of the solder body 410. Also, a rotation coupling groove 411*b* to which a rotation coupling protrusion 541*a* disposed on an inner circumferential surface of a rotation coupling part 541, which will be described below, of the rotating cap 540 is rotatably fitted is disposed on the outer circumferential surface of the solder body 410.

The discharge tube 420 has a hollow circular tube shape and extends perpendicular to a central portion of a top surface of the solder body 410. When the solder unit 400 is coupled to the case body 100, the valve nozzle 320 is connected to the inside of the discharge tube 420. A plurality of elevation guide grooves 421*a* are longitudinally provided in an inner circumferential surface of the discharge tube 420. Thus, since a rotation prevention protrusion 517 of the first cam part 510 is inserted into the elevation guide grooves 421*a*, the rotation prevention protrusion 517 is interlocked with rotation of the second cam part 520 and thus elevatable without the rotation of the first cam part 510.

Figure 16:
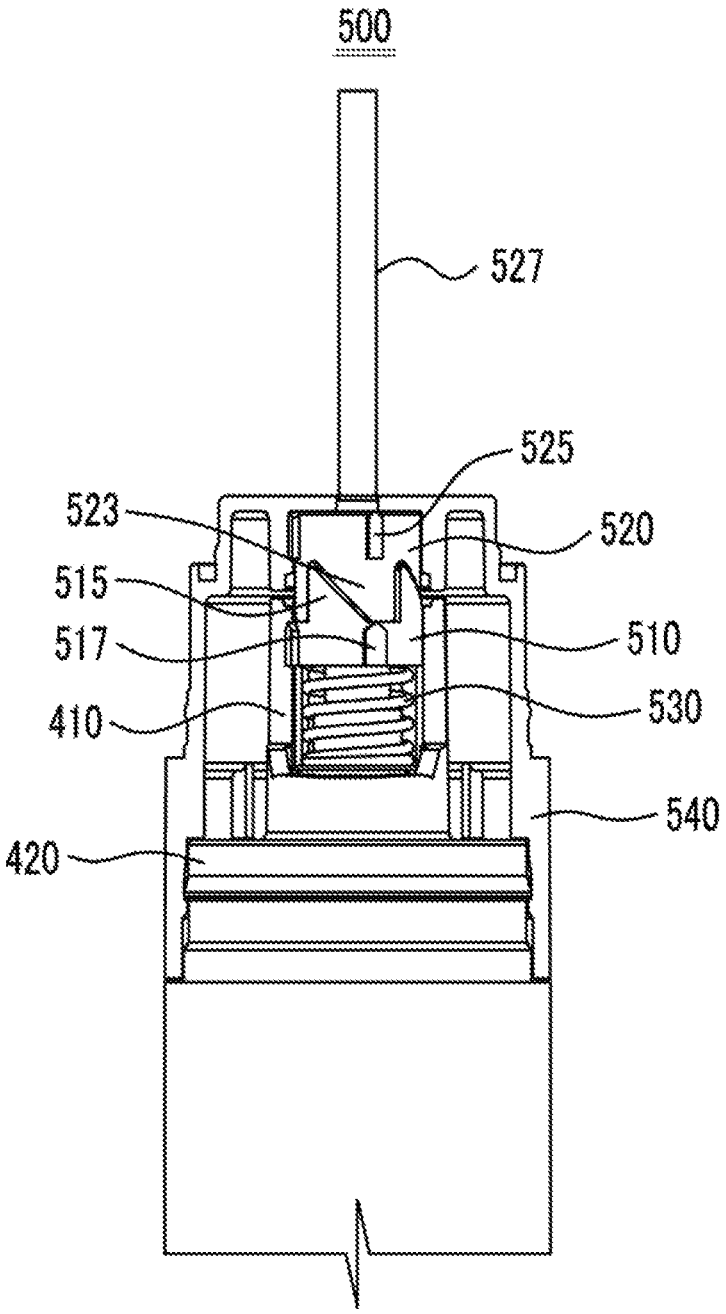
FIG. 16 is a view illustrating a configuration of a valve actuator unit of FIG. 2.

FIG. 16 is a view illustrating a configuration of the valve actuator unit of FIG. 2.

As illustrated in FIG. 16, the valve actuator unit 500 may include a first cam part 510 fitted to be coupled to the valve nozzle 320 and elevated, a second cam part 520 engaged with the first cam part 510 to elevate the first cam part 510 by rotation thereof, an elastic member 530 elastically supporting the first cam part 510 with respect to the valve cap 340, and a rotating cap 540 rotatably coupled to the outside of the solder unit 400 to rotate the second cam part 520. Here, the elastic member 530 may include a spring. The spring 530 has one end contacting and supporting the first cam part 510 and the other end fitted into the other end of the valve cap 340 and then contacting and supporting the cap coupling part 343 of the valve cap 340.

Figure 17:
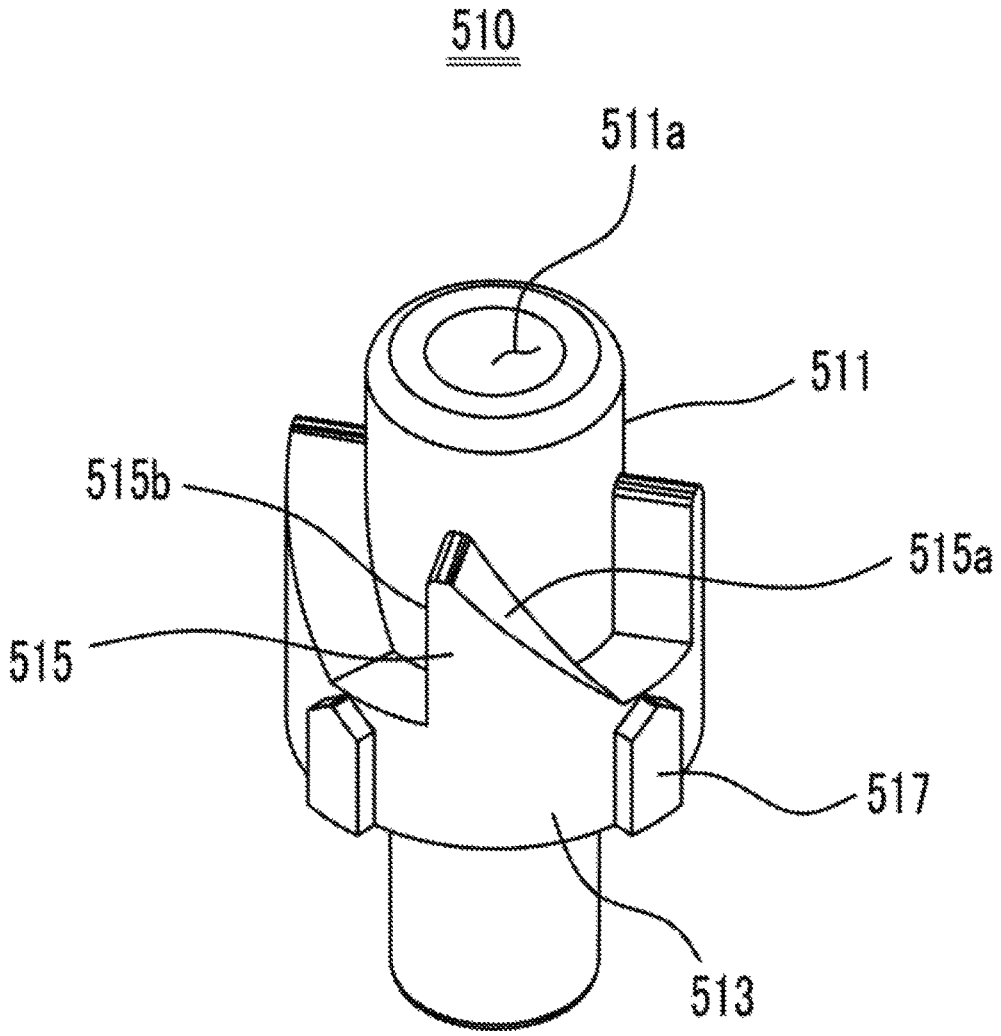
FIG. 17 is a perspective view of a first cam part of FIG. 16.
Figure 18:
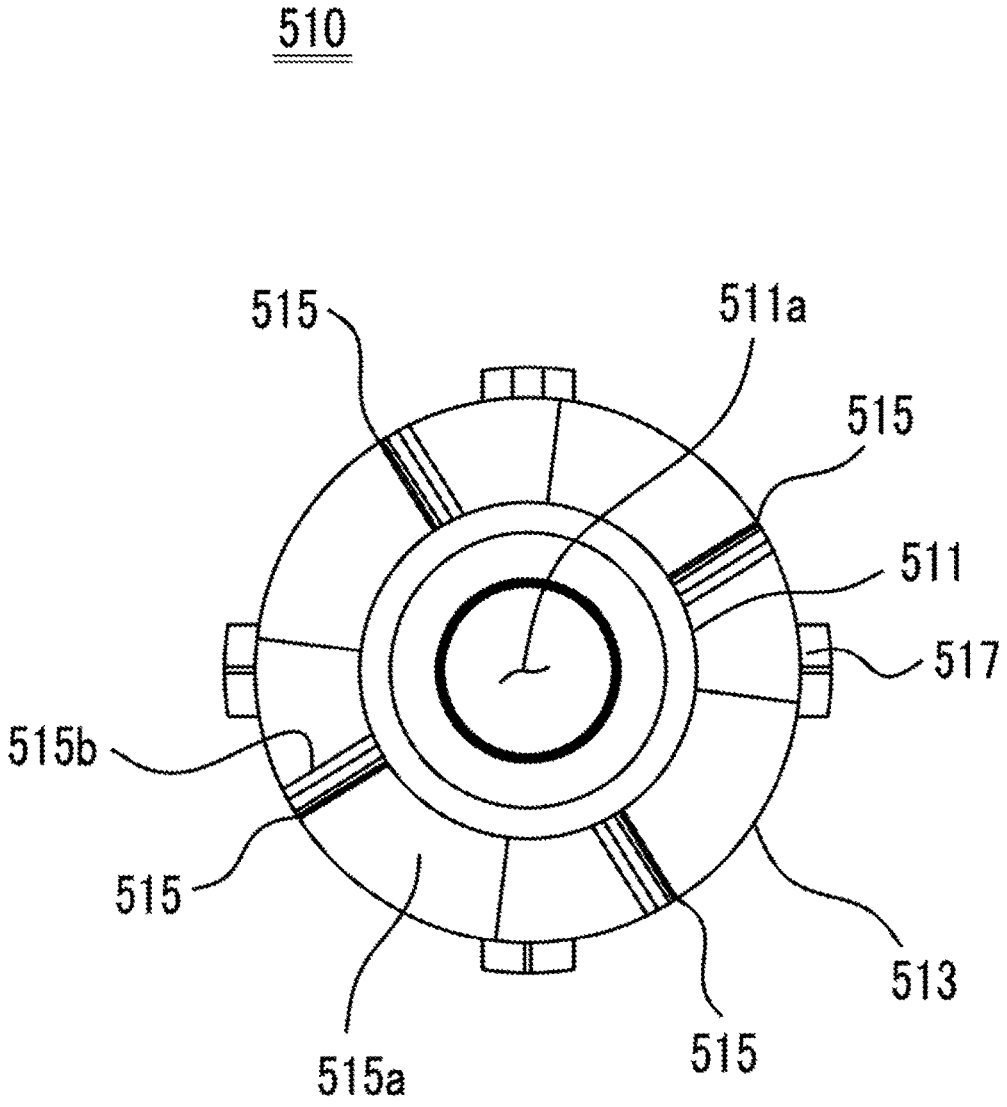
FIG. 18 is a plan view of FIG. 17.
Figure 19:
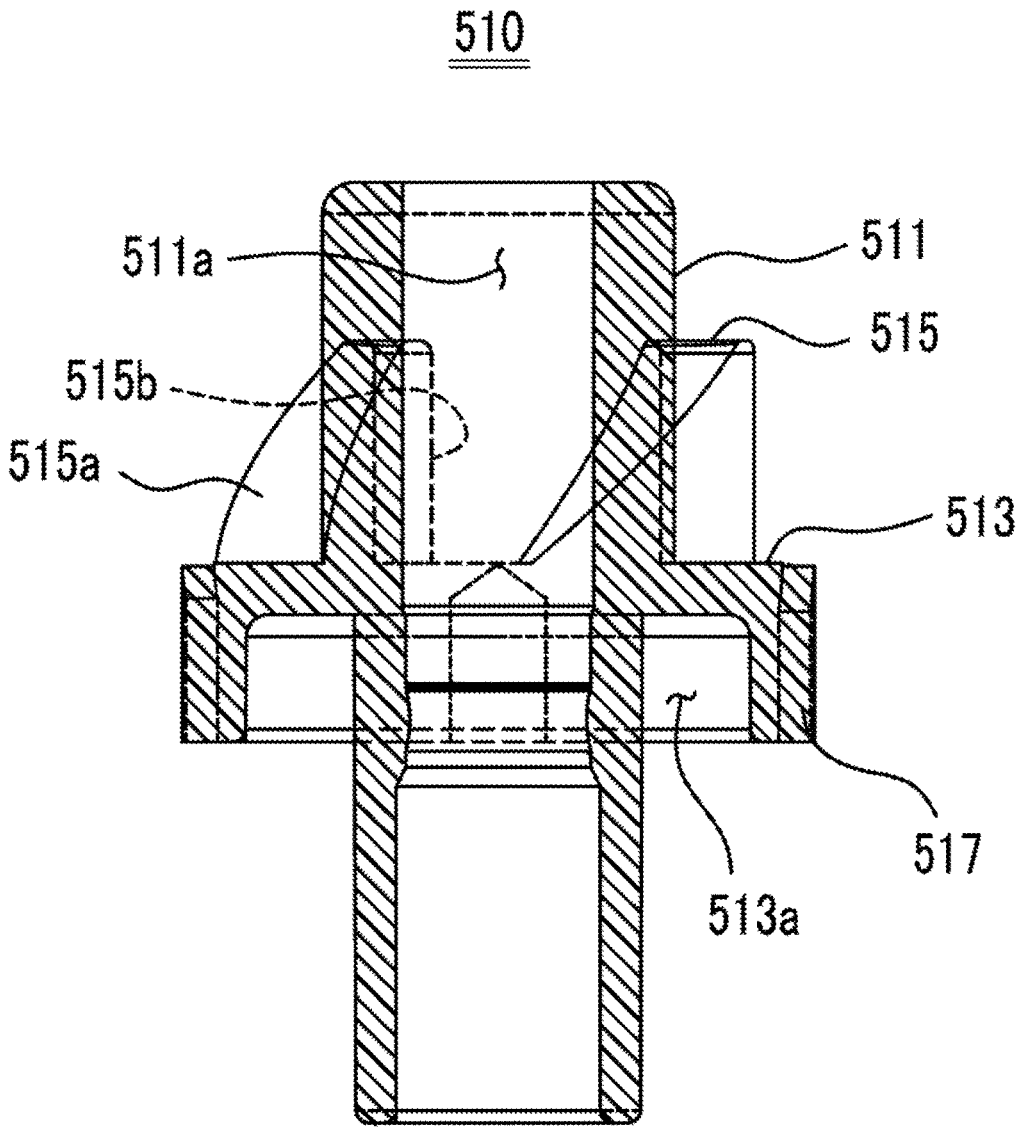
FIG. 19 is a longitudinal cross-sectional view of FIG. 17.

FIG. 17 is a perspective view of the first cam part of FIG. 16, FIG. 18 is a plan view of FIG. 17, and FIG. 19 is a longitudinal cross-sectional view of FIG. 17.

As illustrated in FIGS. 17 to 19, the first cam part 510 is fitted and coupled to the outside of an upper end of the valve nozzle 320 from an upper portion of the valve cap 340 and is interlocked with rotation of the second cam part 520 to allow the valve nozzle 320 fitted into a lower end of the first cam part 510 to slidably move while vertically moving in the discharge tube 420.

The first cam part 510 may include a first cam body 511, an elastic member support part 513, a first inclined sawtooth 515, and a rotation prevention protrusion 517.

The first cam body 511 has a hollow circular tube shape in which a discharge connection hole 511*a* passing through an inner center of the first cam body 511 is defined. The first cam body 511 has one end, i.e., an upper end in the drawing, which is fitted outside a connection tube 522 disposed on the second cam part 520 and the other end to which the opened end of the nozzle body 321 is inserted and coupled to communicate with the nozzle hole 321*a* of the nozzle body 321. A spring 530 is fitted outside the other end of the first cam body 511 to elastically support the first cam body 511 upward with respect to the valve cap 340.

The elastic member support part 513 extends to the outside of the first cam body 511 to support the spring 530 fitted outside the other end of the first cam body 511. A spring fitting groove 513*a* is defined between the elastic member support part 513 and the first cam body 511.

A plurality of first inclined sawteeth 515, for example, four first inclined sawteeth 515 in the drawing are disposed on an upper end of an outer circumferential surface of the first cam body 511 at a predetermined interval. Each of the first inclined sawtooth 515 may have a right triangular shape in which an inclined surface 515*a* and a vertical surface 515*b* cross each other. The first inclined sawtooth 515 protrudes upward from the discharge tube 420 of the solder unit 400 and is engaged with a second sawtooth 523 of the second cam part 520.

At least one rotation prevention protrusion 517 may be disposed on an outer circumferential surface of the first cam body 511, preferably, a plurality of rotation prevention protrusions 517 may be disposed along the outer circumferential surface of the first cam body 511 at a predetermined interval and then inserted into an elevation guide groove 421*a* of the solder unit 400. Thus, the rotation prevention protrusions are interlocked with rotation of the second cam part 520 and thus elevatable without the rotation of the first cam part 510.

Figure 20:
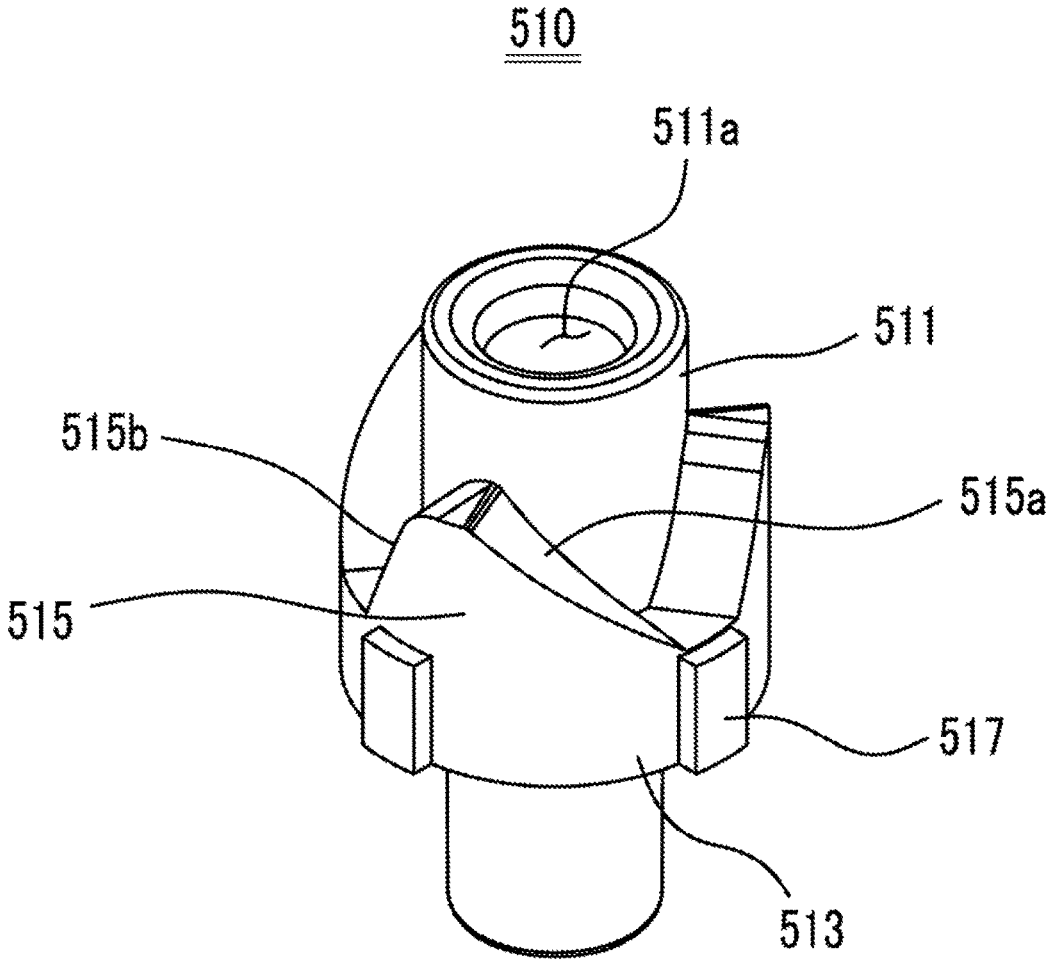
FIG. 20 is a perspective view of a first cam part according to another embodiment.
Figure 21:
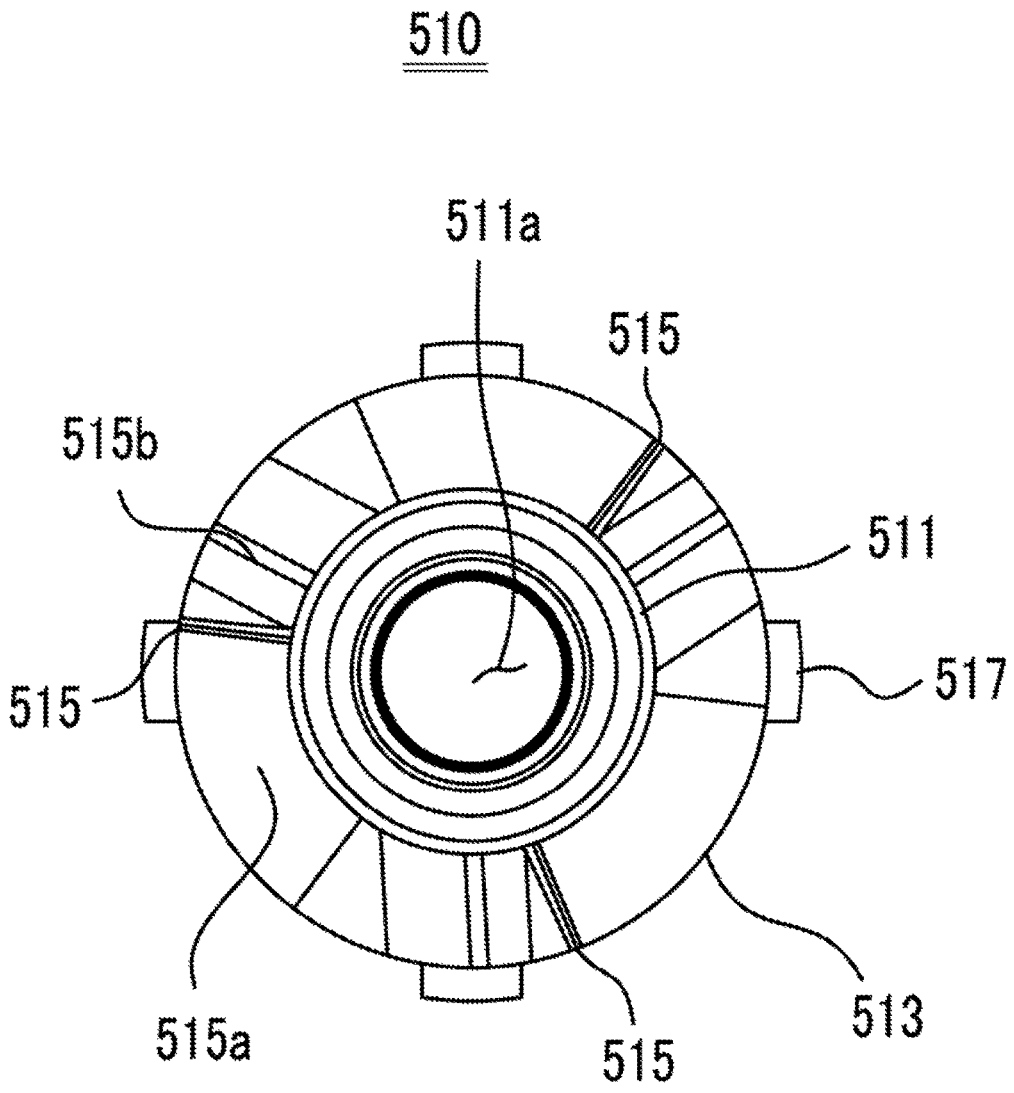
FIG. 21 is a plan view of FIG. 20.
Figure 22:
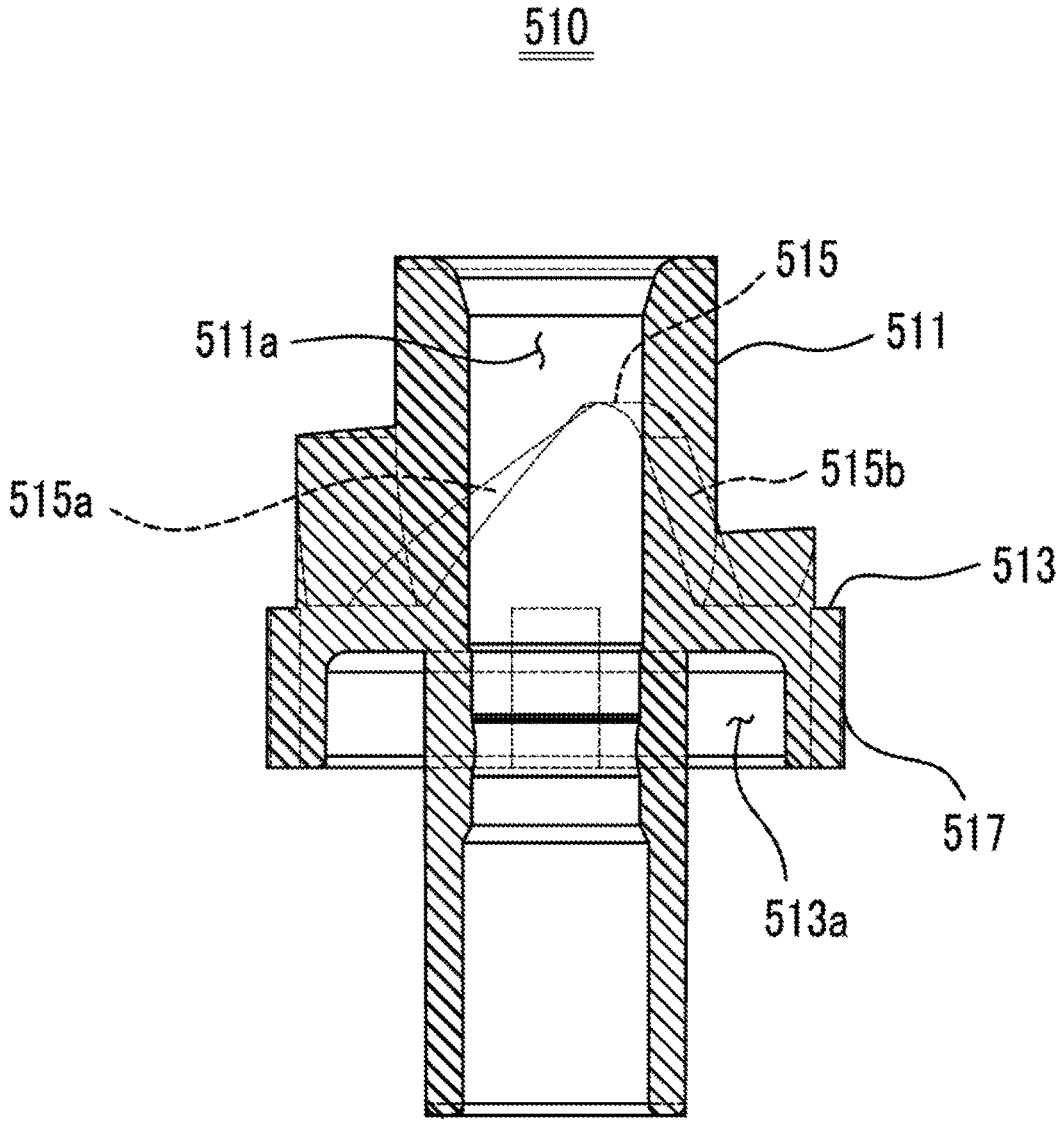
FIG. 22 is a longitudinal cross-sectional view of FIG. 20.

FIG. 20 is a perspective view of a first cam part according to another embodiment, FIG. 21 is a plan view of FIG. 20, and FIG. 22 is a longitudinal cross-sectional view of FIG. 20.

As illustrated in FIGS. 20 to 22, a first cam part 510 includes a first cam body 511, an elastic member support part 513, a first inclined sawtooth 515, and a rotation prevention protrusion 517. The first cam part 510 may be the same as the first cam part 510 of FIGS. 17 to 19 except that three first inclined sawteeth 515 are disposed on an upper end of an outer circumferential surface of the first cam body 511.

According to the current embodiment, when the number of first inclined sawtooth 515 of the first cam part 510 is changed from four into three, since a distance between the teeth of the first inclined sawteeth 515 is increased, a rotation angle of the first cam part 510 may be increased to increase an amount of content to be discharged.

Figure 23:
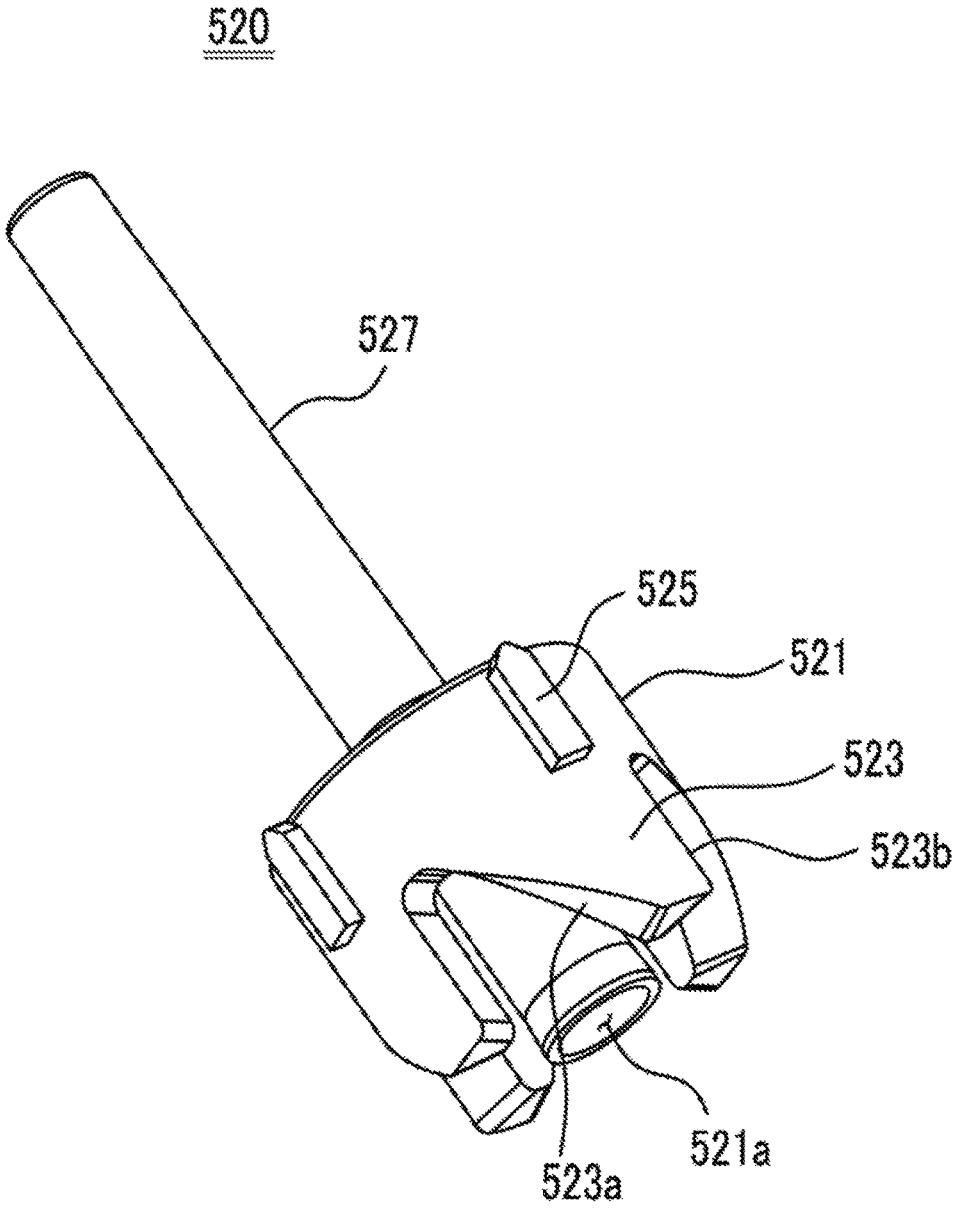
FIG. 23 is a perspective view of a second cam part of FIG. 16.
Figure 24:
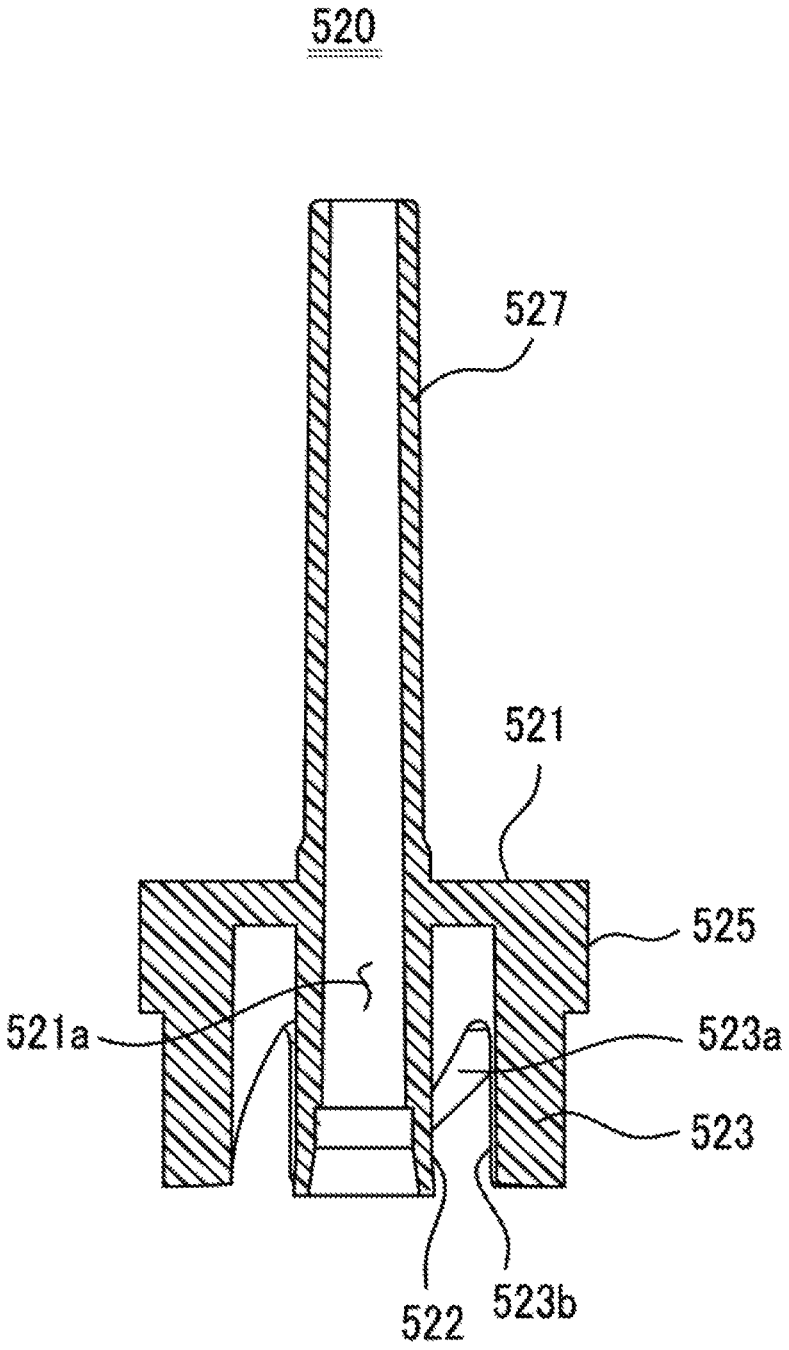
FIG. 24 is a longitudinal cross-sectional view of FIG. 23.

FIG. 23 is a perspective view of the second cam part of FIG. 16, and FIG. 24 is a longitudinal cross-sectional view of FIG. 23.

As illustrated in FIGS. 23 and 24, the second cam part 520 is coupled to the inside of the rotating cap 540 and engaged with the first cam part 510. Thus, the second cam part 520 is rotated by being interlocked with the rotation of the rotating cap 540 to elevate the first cam part 510.

The second cam part 520 may include a second cam body 521, a second sawtooth 523, a fixed protrusion 525, and a transfer tube 527.

The second cam body 521 has a discharge connection hole 521*a* having a hollow circular tube shape to pass through an inner center of the second cam body 521. Thus, a connection tube 522 disposed on a lower end of the second cam body 521 is fitted and coupled to an upper end of the first cam part 510.

A plurality of second inclined sawteeth 523 are disposed on a lower end of an outer circumferential surface of the second cam body 521 at a predetermined interval. Each of the second inclined sawteeth 523 may have a right triangular shape in which an inclined surface 523*a* and a vertical surface 523*b* cross each other and have the same shape as the first inclined sawtooth 515 so that the second inclined sawteeth 523 are engaged with the first inclined sawteeth 515. The second inclined sawteeth 523 are engaged with the first inclined sawteeth 515 and rotated by being interlocked with the rotation of the rotating cap 540 to elevate the first cam part 510 due to inclination contact between the first inclined teeth 515 and the second inclined teeth 523.

At least one fixed protrusion 525 may be disposed on an outer circumferential surface of the second cam body 521, preferably, a plurality of fixed protrusions 525 may be disposed along the outer circumferential surface of the second cam body 521 at a predetermined interval and then inserted and fixed to a plurality of fixing grooves 547*a* defined in an inner circumferential surface of a cam coupling part 547 that will be described below.

The transfer tube 527 lengthily extends in a straight line from one end of the second cam body 521 to pass through a transfer tube insertion hole 546 that will be described below and protrude upward from the rotating cap 540. The transfer tube 527 is inserted into a hole defined in a brush fixing plate (see reference numeral 611 of FIG. 2) that will be described below to supply the transferred content 1 between brush teeth 610*a*.

Figure 25:
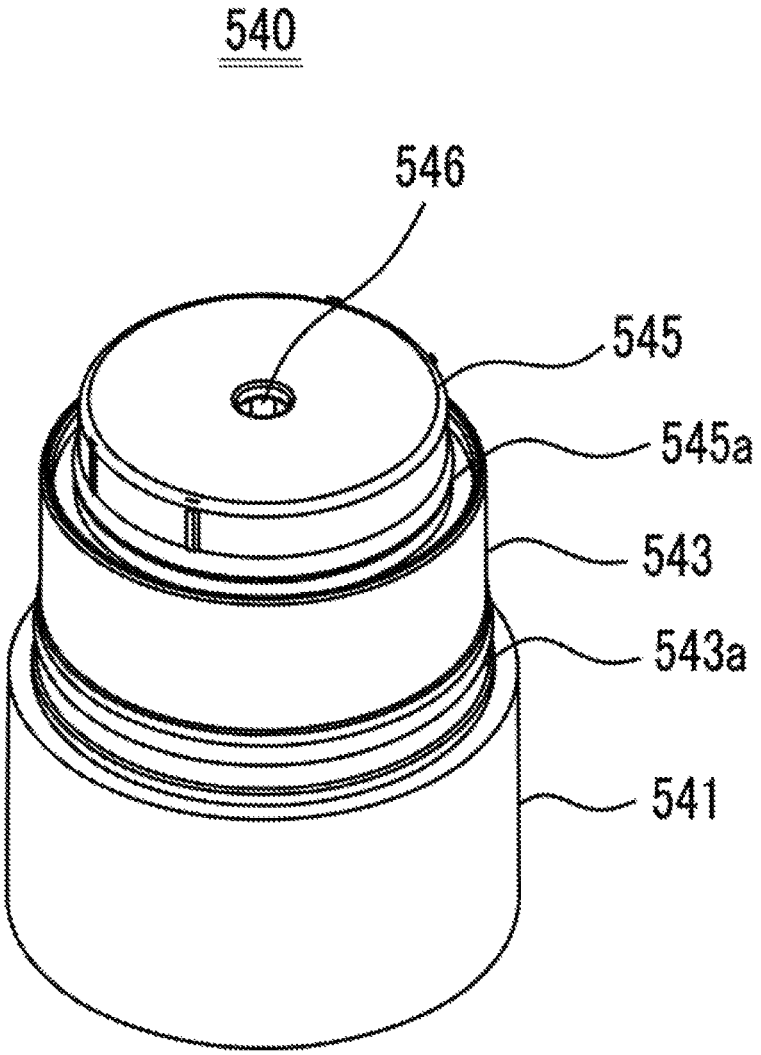
FIG. 25 is a perspective view of a rotating cap of FIG. 16.
Figure 26:
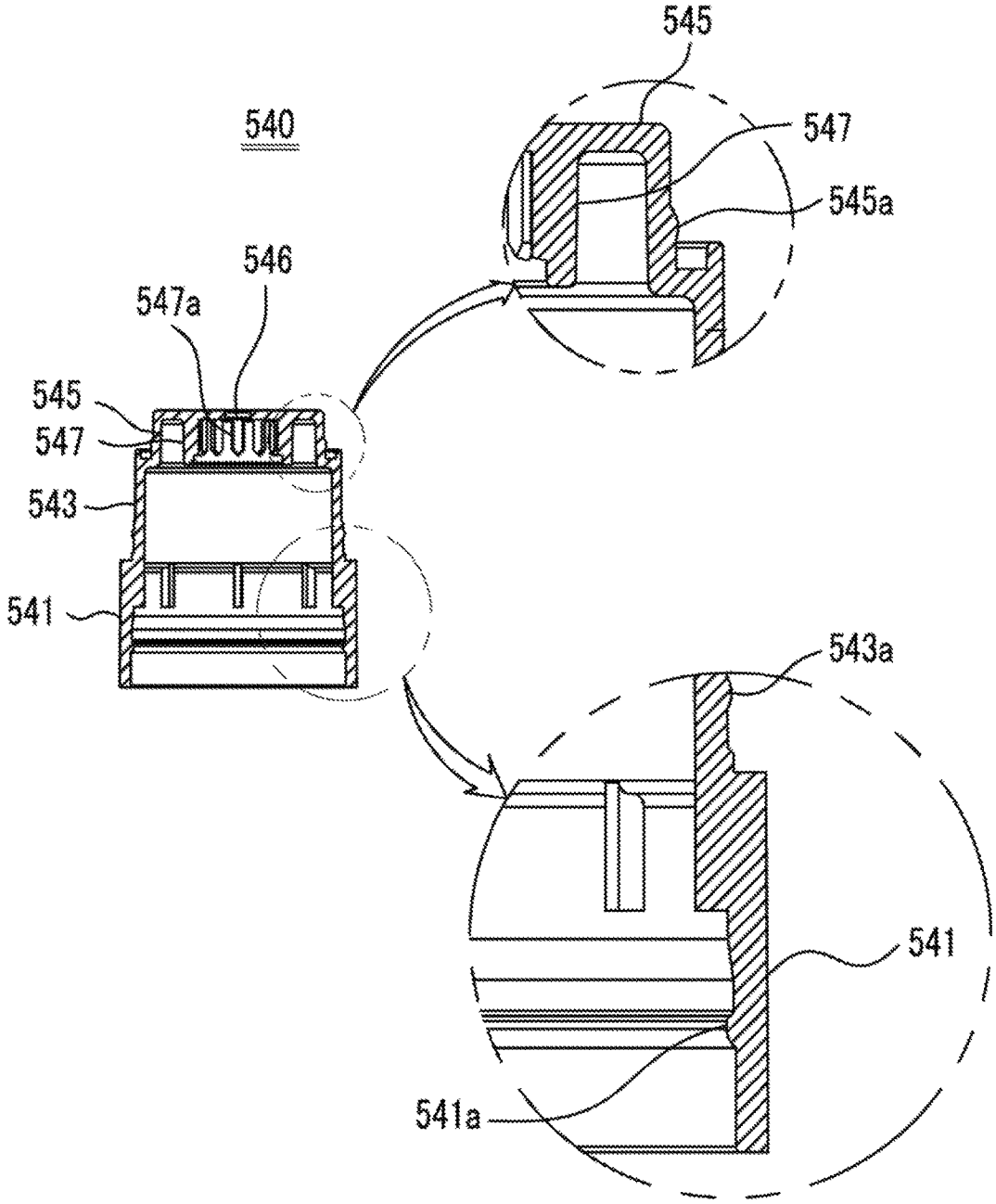
FIG. 26 is a longitudinal cross-sectional view of FIG. 25.

FIG. 25 is a perspective view of the rotating cap of FIG. 16, and FIG. 26 is a longitudinal cross-sectional view of FIG. 25.

As illustrated in FIGS. 25 and 26, the rotating cap 540 is fitted and rotatably coupled to the outside of the solder unit 400. The rotating cap 540 may include a rotation coupling part 541, a lid coupling part 543, a brush holder coupling part 545, and a cam coupling part 547.

The rotation coupling part 541 has a hollow circular tube shape, and an inner surface of the rotation coupling part 541 is fitted and rotatably coupled to an outer surface of the solder unit 400. Also, a rotation coupling protrusion 541*a* is disposed on an inner surface of the rotation coupling part 541 so that the rotation coupling protrusion 541*a* is fitted and rotatably coupled to a rotation coupling groove 411*b* defined in the outer circumferential surface of the solder unit 400.

The lid coupling part 543 extends from one end of the rotation coupling part 541 and has inner and outer diameters less than those of the rotation coupling part 541. Also, the case lid 700 is detachably fitted outside of the lid coupling part 543. A fixed protrusion 543*a* to which the case lid 700 is hooked and fixed protrudes from an outer surface of the lid coupling part 543.

The brush holder coupling part 545 extends from one end of the lid coupling part 543 and has inner and outer diameters less than those of the lid coupling part 543. Also, a top surface of the brush holder coupling part 545 is closed, and the brush holder 600 is detachably fitted outside of the brush holder coupling part 545. A hook projection 545*a* is disposed on a lower end of an outer circumferential surface of the brush holder coupling part 545. Thus, a hook protrusion (see reference numeral 601*a* of FIG. 28) disposed on a lower end of an inner circumferential surface of the brush holder 600 is hooked and fixed to the hook projection 545*a*. Also, a transfer tube insertion hole 546 into which the transfer tube 527 is inserted to pass is defined in a center of a top surface of the brush holder coupling part 545.

The cam coupling part 547 has a hollow circular tube shape that extends inward from the center of the top surface of the brush holder coupling part 545 and to which the second cam part 520 is inserted and coupled. The cam coupling part 547 may have an inner diameter approximately corresponding to an outer diameter of the second cam body 520. A plurality of fixing grooves 547*a* are defined to be spaced apart from each other along an inner circumferential surface of the cam coupling part 547. Thus, the plurality of fixed protrusions 525 disposed on the outer circumferential surface of the second cam body 521 are fitted into the fixing grooves 547*a* to fix and couple the second cam part 520 to the cam coupling part 547.

Figure 27:
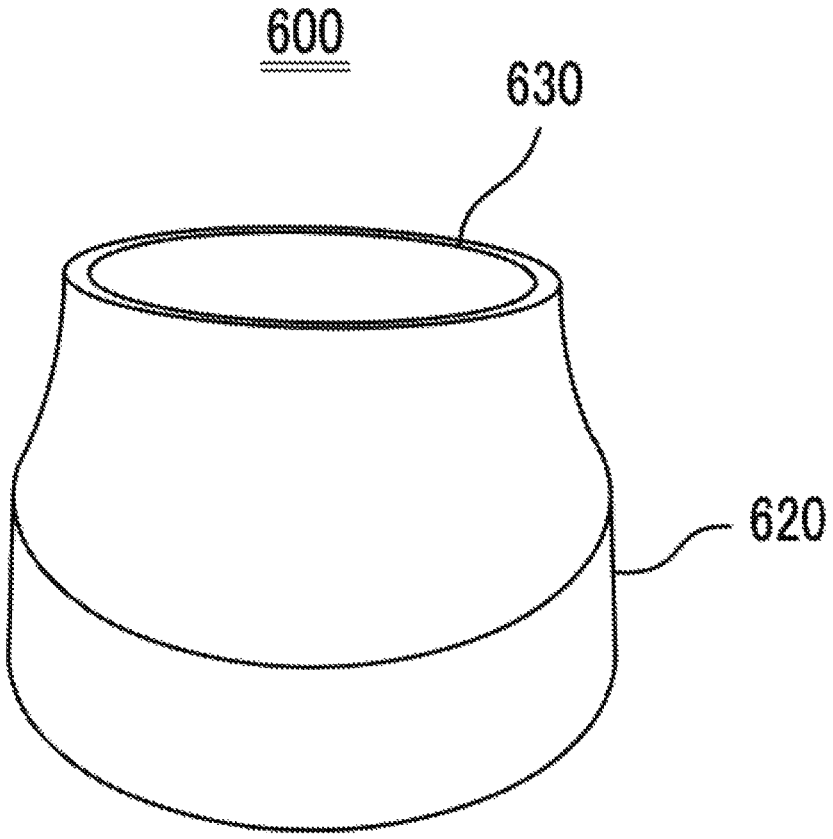
FIG. 27 is a perspective view of a brush holder of FIG. 2.
Figure 28:
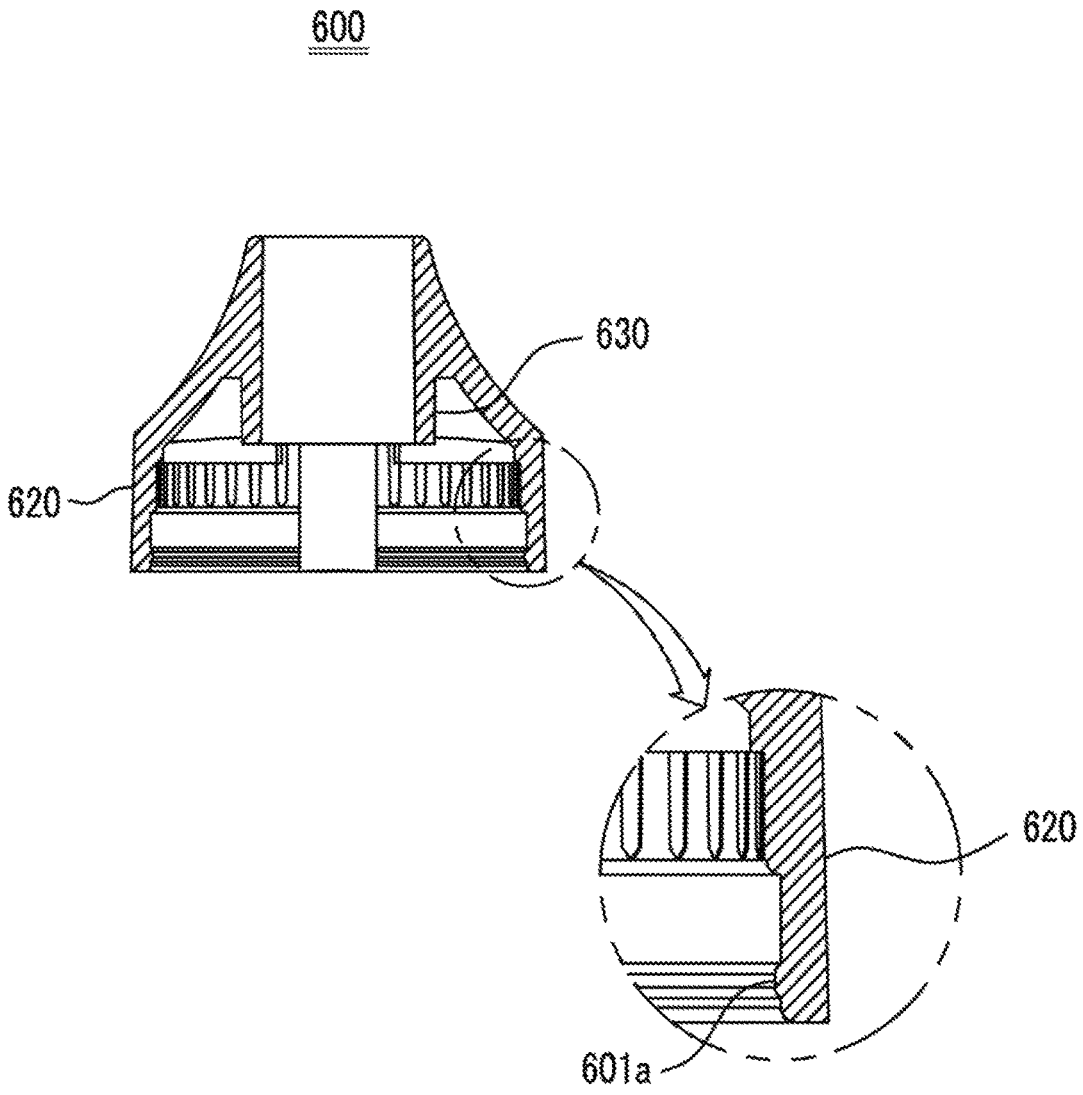
FIG. 28 is a longitudinal cross-sectional view of FIG. 27.

FIG. 27 is a perspective view of the brush holder of FIG. 2, and FIG. 28 is a longitudinal cross-sectional view of FIG. 27.

As illustrated in FIGS. 27 and 28, the brush holder 600 has a hollow circular tube shape and is fitted and coupled to the outside of the brush holder coupling part 545 of the rotating cap 540. A hook protrusion 601*a* is disposed on a lower end of an inner circumferential surface of the brush holder 600. Thus, when the brush holder 600 is fitted into the brush holder coupling part 545, the hook protrusion 601*a* is hooked and then fixed and coupled to the hook projection (see reference numeral 545*a* of FIG. 26) disposed on the lower end of the outer circumferential surface of the brush holder coupling part 545.

The brush insertion part 630 having a tube shape corresponding to a cross-sectional shape of the brush 610 passes through a center of the inside of the brush holder 600 so that the brush 610 is inserted and coupled to a center of the brush holder body 620. In the current embodiment, although the brush insertion part 630 has an oval tube shape to correspond to the shape of the brush 610 having an oval cross-section, the present invention is not limited thereto. For example, the brush insertion part 630 may have a circular tube shape to correspond to the shape of the brush 610 having the circular cross-section. An upper outer portion of the brush holder 600 has a cross-section that is tapered to be gradually decreased upward in cross-section to correspond to the oval brush 610. The brush 610 inserted and coupled to the brush insertion part 630 of the brush holder 600 may be a portion that contacts a skin of a face to perform the makeup. A hole (not shown) into which the transfer tube 527 of the second cam part 520 is inserted is defined in the brush fixing plate 611 to which ends of the plurality of brush teeth 610*a* are attached and fixed. Thus, the liquid content 1 discharged through the transfer tube 527 may be transferred to the brush teeth 610*a*.

Figure 29:
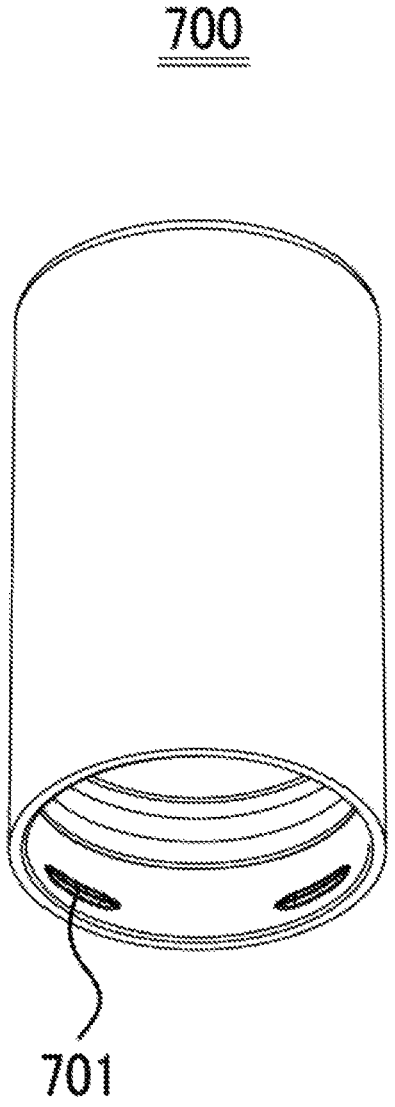
FIG. 29 is a perspective view of a case lid of FIG. 2.
Figure 30:
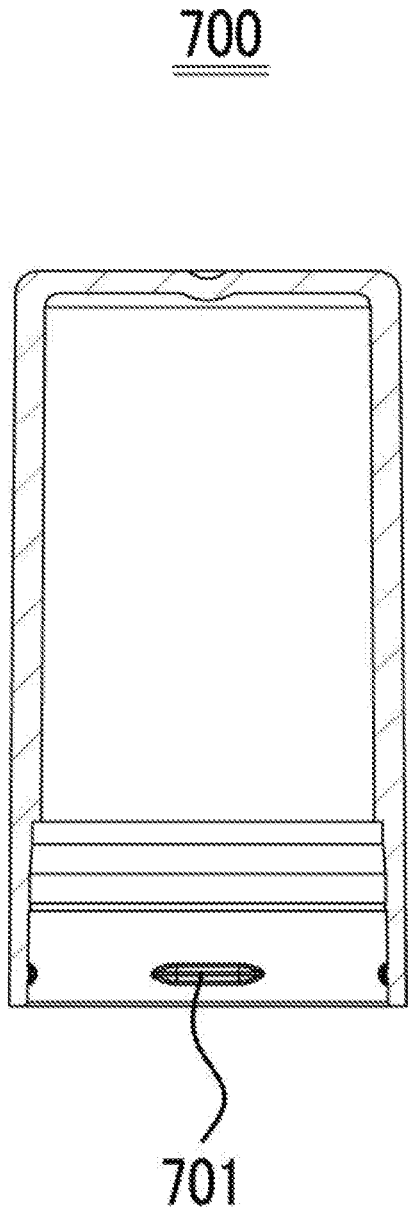
FIG. 30 is a longitudinal cross-sectional view of FIG. 29.

FIG. 29 is a perspective view of the case lid of FIG. 2, and FIG. 30 is a longitudinal cross-sectional view of FIG. 29.

As illustrated in FIGS. 29 and 30, one end of the case lid 700 is opened and detachably fitted and coupled to the outside of the lid coupling part 543 of the rotating cap 540. A fixed protrusion 701 engaged with the fixed protrusion 543*a* disposed on the outside of the lid coupling part 543 to prevent the case lid 700 from being separated protrudes from the inside of the opened portion of the case lid 700.

Figure 31:
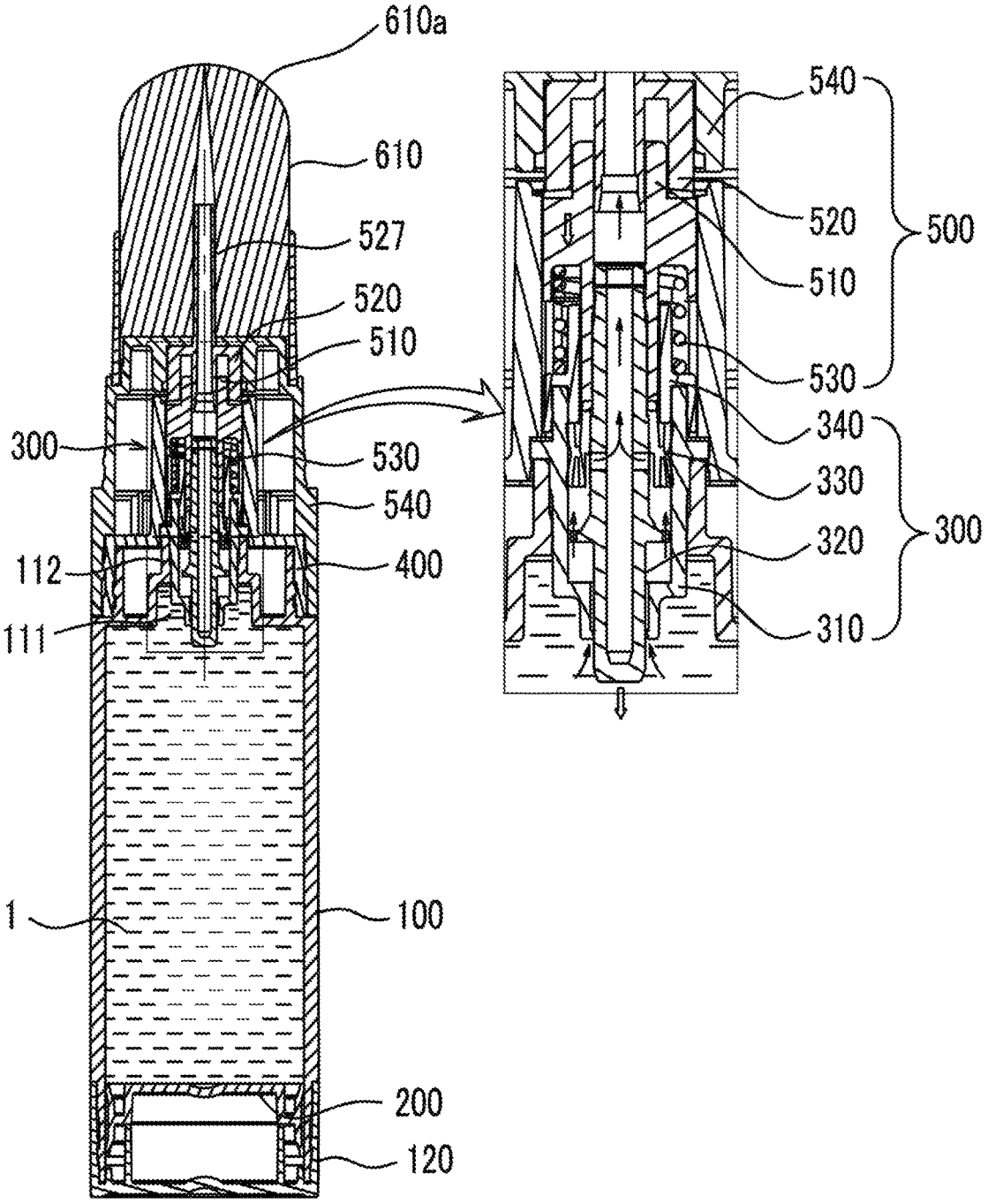
FIG. 31 is a cross-sectional view illustrating a state in which a content within the liquid cosmetics case is discharged according to an embodiment of the present invention.

FIG. 31 is a cross-sectional view illustrating a state in which a content within the liquid cosmetics case is discharged according to an embodiment of the present invention.

As illustrated in FIG. 31, when the user rotates the rotating cap 540 in one direction, for example, a clockwise direction, the second cam part 520 fixed to the inside of the rotating cap 540 is integrally rotated with the rotating cap 540. Then, the second cam part 520 is engaged with the first cam part 510 and rotated by being interlocked with the rotation of the rotating cap 540 to elevate the first cam part 510 due to the inclination contact between the first inclined sawtooth 515 of the first cam part 510 an the second inclined sawtooth 523 of the second cam part 520.

Here, the inclined surface of the second inclined sawtooth 523 disposed on the second cam part 520 is interlocked with the rotation of the rotating cap 540 in a state in which the inclined surface of the second inclined sawtooth 523 correspondingly contacts the inclined surface 515*a* of the first inclined sawtooth 515. Thus, when the second cam part 520 is rotated, the rotation movement of the second cam part 520 is converted into linear movement of the first cam part 510 by an inclined angle between the inclined surfaces 515*a* and 523*a* of the first and second inclined teeth 515 and 523 to allow the first cam part 510 to descend by a vertical height of the inclined surface, i.e., a height of a vertical surface. In this process, the nozzle body 321 of the valve nozzle 320 to which the lower end of the first cam part 510 is fitted and coupled moves downward, i.e., moves toward the discharge hole 111 by being interlocked with the descending of the first cam part 510. Here, the switching member 330 fitted and movably coupled to the outside of the nozzle body 321 is slid to a side opposite to the discharge hole 111 by a pressure of the content 1 introduced between the valve housing 310 and the nozzle body 321.

When the switching member 330 is slid to the side opposite to the discharge hole 111 to allow the clearance groove 331*a* defined in the inside of the switching part 331 to correspond to the inflow hole 321*b* defined in the nozzle body 321, the liquid content 1 is introduced into the nozzle hole 321*a* through the clearance groove 331*a* and the inflow hole 321*b*.

The content 1 introduced into the nozzle hole 321*a* is transferred to the transfer tube 527 through the first cam body 511 connected to the nozzle body 321 and the discharge connection holes 511*a* and 521*a* of the second cam body 521 and then discharged. Thereafter, the content 1 discharged through the transfer tube 527 is discharged between the brush teeth 610*a* and then smoothly stained with the brush teeth 610*a*.

Figure 32:
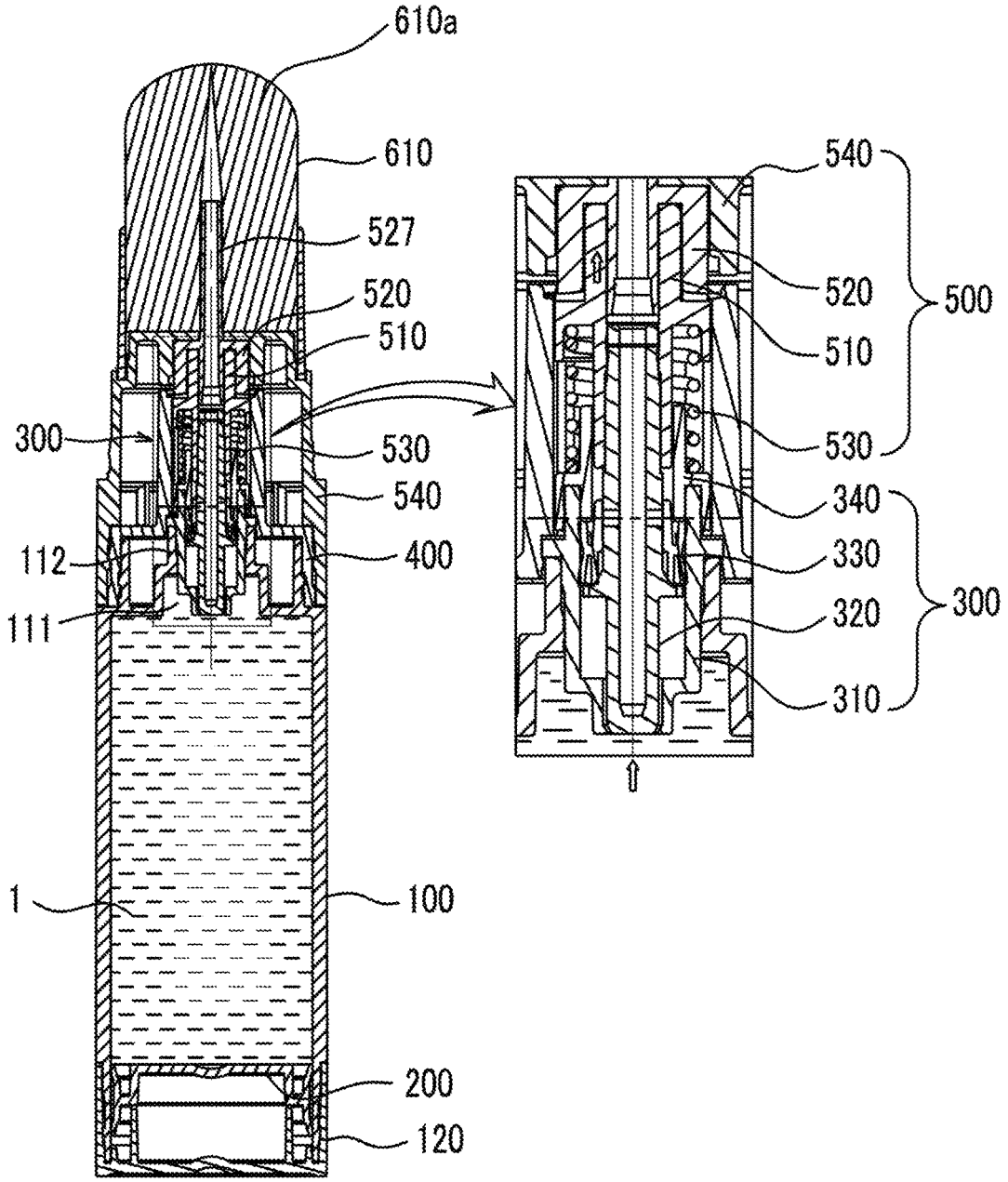
FIG. 32 is a cross-sectional view illustrating a state in which the discharge of the content within the liquid cosmetics case is blocked according to an embodiment of the present invention.

FIG. 32 is a cross-sectional view illustrating a state in which the discharge of the content within the liquid cosmetics case is blocked according to an embodiment of the present invention.

As illustrated in FIG. 32, when the first cam part 510 descends to open the valve unit 300, and then, the rotating cap 540 is further rotated in a state in which the content 1 is discharged, the vertical surface 523*b* of the second inclined sawtooth 523 disposed on the second cam part 520 corresponds to the vertical surface 515*b* of the first inclined sawtooth 515 disposed on the first cam part 510 to release the inclination contact between the inclined surfaces 515*a* and 523*a* of the first and second inclined sawteeth 515 and 523. Then, the first cam part 510 ascends while returning to its original state by restoring force of the spring 530. In this process, the nozzle body 321 of the valve nozzle 320 to which the lower end of the first cam part 510 is fitted and coupled moves downward, i.e., moves to the side opposite to the discharge hole 111 by being interlocked with the ascending of the first cam part 510. When the nozzle body 321 moves to the side opposite to the discharge hole 111, i.e., when the nozzle body 321 ascends, the switching member 330 is pushed by the nozzle body 321 to return to its original state, thereby closing the inflow hole 321*b*. Thus, the discharge of the content 1 is stopped.

Figure 33:
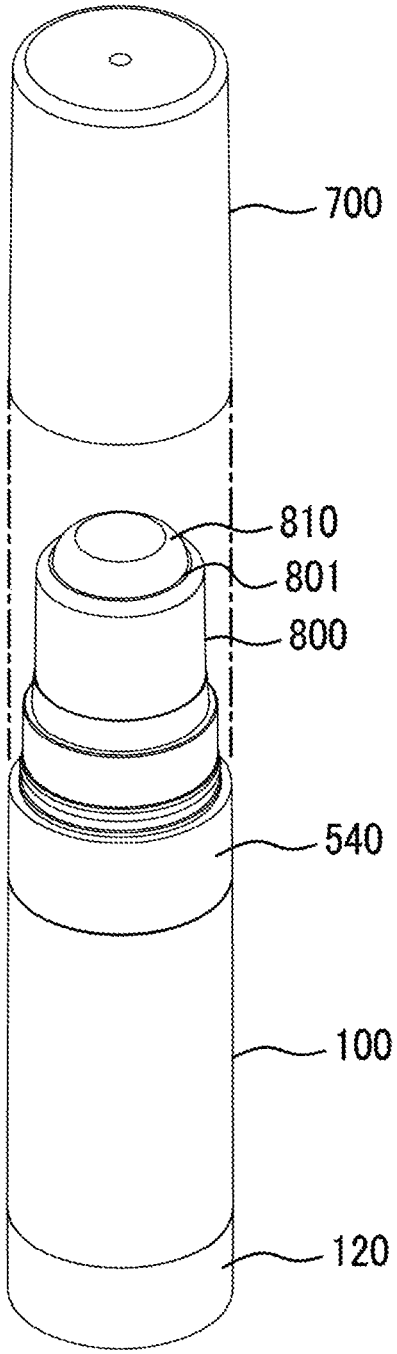
FIG. 33 is a perspective view of a liquid cosmetics case according to another embodiment of the present invention.

FIG. 33 is a perspective view of a liquid cosmetics case according to another embodiment of the present invention.

As illustrated in FIG. 33, a liquid cosmetics case according to another embodiment of the present invention is a constituent in which the brush 610 according to the foregoing embodiment is substituted with a sponge ball 810. Thus, detailed descriptions with respect to constituents, which perform the same function as those according to the foregoing embodiment, will be omitted. Hereinafter, only a sponge ball holder 800 and a sponge ball 810, which are different from the constituents according to the foregoing embodiment, will be described in detail below.

The sponge ball holder 800 has a hollow circular tube shape and is fitted and coupled to the outside of the upper end of the rotating cap 540.

A sponge ball insertion part 801 passes through a top surface of the sponge ball holder 800. Thus, the hemispherical sponge ball 810 is inserted into the sponge ball insertion part 801 from the inside of the sponge ball holder 800, and a top surface of the sponge ball 810 protrudes outward from the sponge ball insertion part 801. The sponge ball 810 may be a portion that contacts a skin of a face to perform the makeup. The second cam part 520 is rotated by the rotation of the rotating cap 540 to elevate the first cam part 510, thereby opening and closing the valve unit 300. Thus, the liquid content 1 within the case body 100 is transferred to the sponge ball 810 and then smoothly stained with the sponge ball 810.

According to the liquid cosmetics case according to the present invention, when the user rotates the rotating cap 540, the valve nozzle 320 of the valve unit 300 is elevated to open and close the discharge hole 111. Thus, the discharge and blocking of the liquid content 1 may be simply adjusted to improve the convenient in use. Also, since the valve type in which the discharge hole is opened and closed due to the elevation of the valve nozzle is applied, the discharging portion may be always sealed on ordinary days. Thus, the liquid cosmetics case may have the superior sealability and be applied to all liquid contents regardless of viscosity Also, since the valve type is applied, the valve type liquid cosmetics case may be simplified in structure and have low manufacturing costs when compared to the existing button type and rotary type liquid cosmetics case. In addition, the valve type liquid cosmetics case may be minimized in breakdown and malfunction.

The liquid cosmetics case according to the present invention may have following effects.

First, according to the present invention, when being rotated, the valve nozzle of the valve unit is elevated to open and close the discharge hole, thereby simply adjusting the discharging and blocking of the liquid content. Thus, the liquid cosmetics case may be very convenient in use.

Second, according to the present invention, since the valve type in which the discharge hole is opened and closed due to the elevation of the valve nozzle is applied, the discharging portion may be always sealed on ordinary days. Thus, the liquid cosmetics case may have the superior sealability and be applied to all liquid contents regardless of the viscosity.

Third, according to the present invention, since the valve type is applied, the valve type liquid cosmetics case may be simplified in structure and have low manufacturing costs when compared to the existing button type and rotary type liquid cosmetics case. In addition, the valve type liquid cosmetics case may be minimized in breakdown and malfunction.

Although the embodiment of the present invention is described with reference to the accompanying drawings, those with ordinary skill in the technical field of the present invention pertains will be understood that the present invention can be carried out in other specific forms without changing the technical idea or essential features. Thus, the above-disclosed embodiments are to be considered illustrative and not restrictive. Accordingly, the scope of the present invention is defined by the appended claims rather than the foregoing description and the exemplary embodiments described therein. Various modifications made within the meaning of an equivalent of the claims of the invention and within the claims are to be regarded to be in the scope of the present invention.

What is claimed is:

1. A liquid cosmetics case comprising:

a case body filled with a liquid content and having one end in which a valve insertion part communicating with a discharge hole is defined;

a valve unit installed to be inserted into the valve insertion part, the valve unit opening and closing the discharge hole;

a solder unit coupled to one end of the case body to support the valve unit and in which a hollow discharge tube is provided; and a valve actuator unit rotatably coupled to the solder unit, the valve actuator unit being rotated to elevate a valve nozzle of the valve unit, thereby opening and closing the discharge hole, wherein, when the valve actuator unit is rotated to allow the valve nozzle to descend, the discharge hole is opened to discharge the content, and when the valve actuator unit is rotated to allow the valve nozzle to ascend, the discharge hole is closed to block the discharge of the content;

wherein the valve actuator unit comprises a first cam part fitted and coupled to the outside of the valve nozzle from an upper side of a valve cap, the first cam part having a first discharge connection hole communicating with a nozzle hole of the valve nozzle, the first discharge connection hole is defined to pass through a center of the first cam part, and a plurality of first inclined sawteeth are disposed on an upper end of an outer circumferential surface of the first cam part; and wherein the first cam part comprises a first cam body having a hollow circular tube shape, the first cam body having one end fitted and connected to the outside of a connection tube disposed on a second cam part and the other end into which an opened end of a nozzle body of the valve nozzle is fitted; and an elastic member being installed to elastically support the first cam part with respect to the valve cap by an elastic member support part extending from the outside of the first cam body to retain the elastic member fitted outside the other end of the first cam body; and wherein the valve actuator unit further comprises a rotating cap fitted and rotatably coupled to the outside of the solder unit; and wherein the second cam part coupled to the inside of the rotating cap, the second cam part having a second discharge connection hole connected to the first discharge connection hole of the first cam part, the second discharge connection hole is defined to pass through a center of the second cam part, and a plurality of second inclined sawteeth engaged with the first inclined sawteeth are disposed on a lower end of an outer circumferential surface of the second cam part.

2. The liquid cosmetics case of claim 1, wherein the valve unit comprises:

a valve housing inserted and coupled to the valve insertion part from the outside the case body;

the valve nozzle passing through the valve housing to vertically move, the valve nozzle having the nozzle hole communicating with the discharge tube therein and an inflow hole connected to the nozzle hole to introduce the content into the nozzle hole in a side portion of the valve nozzle;

a switching member movably fitted outside the valve nozzle, the switching member being pushed to a side opposite to the discharge hole by a pressure of the content introduced between the valve housing and the valve nozzle to open the inflow hole when the valve nozzle moves toward the discharge hole and pushed by the valve nozzle to return to its original state and close the inflow hole when the valve nozzle moves to the side opposite to the discharge hole; and the valve cap coupled to the valve housing so that an upper portion of the valve nozzle passes through the valve cap.

3. The liquid cosmetics case of claim 2, wherein the nozzle body in which the nozzle hole opened to the one end of the nozzle body, is defined in a longitudinal direction, and the inflow hole connected to the nozzle hole is defined in a side portion of the nozzle body; and wherein the valve nozzle further comprises an annular protrusion disposed at a position of the side portion of the nozzle body, which is spaced apart from the inflow hole toward the other closed end of the nozzle body, the annular protrusion having a fine hole through which the content introduced between the other end of the nozzle body and the valve housing passes.

4. The liquid cosmetics case of claim 2, wherein the solder unit comprises:

a solder body fitted and coupled to the outside of one end of the case body; and the hollow discharge tube extending perpendicular to a central portion of a top surface of the solder body and to which the valve nozzle of the valve unit is connected to the inside of the hollow discharge tube.

5. The liquid cosmetics case of claim 1, wherein the first cam part is interlocked with rotation of the second cam part to vertically move in the discharge tube of the solder unit, and the first inclined sawteeth protrude upward from the discharge tube and are engaged with the second inclined sawteeth.

6. The liquid cosmetics case of claim 5, wherein at least one rotation prevention protrusion protrudes from an outer circumferential surface of the first cam part, and at least one elevation guide groove is longitudinally defined in an inner circumferential surface of the discharge tube of the solder unit so that the rotation prevention protrusion is inserted into the elevation guide groove, and the first cam part is elevated without the rotation of the first cam part by being interlocked with the rotation of the second cam part.

7. The liquid cosmetics case of claim 6, wherein the rotating cap comprises:

a rotation coupling part having a hollow circular tube shape and fitted and rotatably coupled to the outside of the solder unit;

a lid coupling part extending from one end of the rotation coupling part and having inner and outer diameters less than those of the rotation coupling part and in a case lid is detachably fitted to the outside of the lid coupling part;

a brush holder coupling part extending from one end of the lid coupling part and having inner and outer diameters less than those of the lid coupling part and a closed top surface and in which a brush holder is detachably fitted to the outside of the brush holder coupling part; and a hollow cam coupling part extending inward from a center of a top surface of the brush holder coupling part and to which the second cam part is coupled.

8. The liquid cosmetics case of claim 7, wherein the rotation coupling part comprises a rotation coupling protrusion that protrudes from an inner circumferential surface of the rotation coupling part so that the rotation coupling protrusion is fitted and rotatably coupled to the rotation coupling groove defined in the outer circumferential surface of the solder unit.

9. The liquid cosmetics case of claim 7, wherein the brush holder coupling part has a transfer tube insertion hole, through which a transfer tube disposed on one end of the second cam part is inserted to pass, in a center of a top surface of the brush holder coupling part.

10. The liquid cosmetics case of claim 9, wherein the second cam part comprises:

a second cam body having a hollow circular tube shape, the second cam body having one end on which the transfer tube is disposed to pass through the transfer tube insertion hole and protrude upward from the rotating cap and the other end on which the connection tube is disposed to be fitted and coupled to one end of the first cam part;

and at least one fixed protrusion disposed on the outer circumferential surface of the second cam body of the second cam part and inserted and fixed to a plurality of fixing grooves defined in an inner circumferential surface of the cam coupling part.

* * * * *